US007705793B2

(12) United States Patent
Kaplan et al.

(10) Patent No.: US 7,705,793 B2
(45) **Date of Patent: *Apr. 27, 2010**

(54) APPLICATIONS FOR LOW PROFILE TWO WAY SATELLITE ANTENNA SYSTEM

(75) Inventors: Ilan Kaplan, North Bethesda, MD (US); Mario Ganchev Gachev, Sofia (BG); Bercovich Moshe, McLean, VA (US); Danny Spirtus, Holon (IL); Daniel Francis DiFonzo, Rockville, MD (US); Kevin Arthur Bruestle, Falls Church, VA (US); Robert Yip, Vienna, VA (US); Victor Boyanov, Sofia (BG); Yoel Gat, Airport (IL)

(73) Assignee: RaySat Antenna Systems, Vienna, VA (US)

( * ) Notice: Subject to any disclaimer, the term of this patent is extended or adjusted under 35 U.S.C. 154(b) by 404 days.

This patent is subject to a terminal disclaimer.

(21) Appl. No.: 11/320,805

(22) Filed: Dec. 30, 2005

(65) Prior Publication Data

US 2006/0284775 A1 Dec. 21, 2006

Related U.S. Application Data

(63) Continuation-in-part of application No. PCT/US2005/028507, filed on Aug. 10, 2005, and a continuation-in-part of application No. 11/074,754, filed on Mar. 9, 2005, now abandoned, and a continuation-in-part of application No. 11/071,440, filed on Mar. 4, 2005, and a continuation-in-part of application No. 10/925,937, filed on Aug. 26, 2004, now Pat. No. 7,379,707, and a continuation-in-part of application No. 10/498,668, filed on Jun. 10, 2004, now Pat. No. 6,995,712.

(60) Provisional application No. 60/653,520, filed on Feb. 17, 2005, provisional application No. 60/650,122, filed on Feb. 7, 2005.

(51) Int. Cl.
*H01Q 1/32* (2006.01)
*H01Q 1/12* (2006.01)

(52) U.S. Cl. ..... 343/713; 343/878

(58) Field of Classification Search ..... 343/711–713, 343/766, 878

See application file for complete search history.

(56) References Cited

U.S. PATENT DOCUMENTS 4,903,033 A 2/1990 Tsao et al.

(Continued)

FOREIGN PATENT DOCUMENTS

WO WO 99/31757 6/1999

(Continued)

OTHER PUBLICATIONS

D. Chang et al., "Compact Antenna Test Range Without Reflector Edge Treatment and RF Anechoic Chamber", IEEE Antenna & Propagation Magazine, vol. 46, No. 4, pp. 27-37, dated Aug. 2004.

(Continued)

*Primary Examiner*—Shih-Chao Chen
(74) *Attorney, Agent, or Firm*—Banner & Witcoff, Ltd.

(57) ABSTRACT

Antenna assemblies and associated satellite tracking systems that may include a low profile two-way antenna arrangement, tracking systems, and applications thereof. Applications for the system include military, civilian, and domestic emergency response applications. The antenna arrangements may be configured to form a spatial element array able to track a satellite in an elevation plane by electronically dynamically targeting the antenna arrangement and/or mechanically dynamically rotating the antenna arrangements about transverse axes giving rise to generation of respective elevation angles and dynamically changing the respective distances between the axes whilst maintaining a predefined relationship between said distances and the respective elevation angles. The system provides dynamic tracking of satellite signals and can be used for satellite communications on moving vehicles in military and civilian applications.

17 Claims, 24 Drawing Sheets

U.S. PATENT DOCUMENTS

| | | | | |
|---|---|---|---|---|
| 5,005,019 | A | 4/1991 | Zaghloul et al. | |
| 5,043,738 | A | 8/1991 | Shapiro et al. | |
| 5,245,348 | A | 9/1993 | Nishikiawa | |
| 5,408,241 | A | 4/1995 | Shattuck et al. | |
| 5,835,057 | A * | 11/1998 | van Heyningen | 342/359 |
| 5,929,819 | A * | 7/1999 | Grinberg | 343/754 |
| 6,018,320 | A | 1/2000 | Jidhage et al. | |
| 6,023,244 | A | 2/2000 | Saygg et al. | |
| 6,111,542 | A * | 8/2000 | Day et al. | 342/359 |
| 6,124,832 | A | 9/2000 | Jeon et al. | |
| 6,191,734 | B1 | 2/2001 | Park | |
| 6,377,211 | B1 | 4/2002 | Hsiung | |
| 6,927,736 | B1 * | 8/2005 | Kornbau et al. | 343/712 |
| 7,339,520 | B2 * | 3/2008 | Chang et al. | 342/359 |
| 2002/0167449 | A1 | 11/2002 | Frazita et al. | |
| 2003/0090416 | A1 | 5/2003 | Howell et al. | |
| 2003/0097658 | A1 * | 5/2003 | Richards | 725/69 |
| 2004/0087294 | A1 | 5/2004 | Wang | |
| 2008/0018545 | A1 * | 1/2008 | Kaplan et al. | 343/713 |

FOREIGN PATENT DOCUMENTS

| | | | |
|---|---|---|---|
| WO | 0111718 | A | 2/2001 |
| WO | 02097919 | A | 12/2002 |
| WO | 2004075339 | A | 9/2004 |

OTHER PUBLICATIONS

K-L Wong et al., "Broad-Band Single-Patch Circularly Plarized Microstrip Antenna Withdual Capacitivity Coupled Feeds", IEEE Transactions on Antenna and Propagation, vol. 49, No. 1, pp. 41-44, dated Jan. 2001.

RaySat Inc.: Press release, Online,Jan. 6, 2005, retrieved from the Internet: http://www.raysat.us/news/release/01-16-05-internet.asp.

EP 06127356.1 extended Search Report dated Nov. 1, 2007.

Soon Ik Jeon et al., "Active Phased Array Antenna for Mobile Multimedia Services Via Satellite," Aerospace Conference Proceedings, 2000 IEEE Mar. 18-25, 2000, Piscataway, NJ, IEEE, vol. 5, Mar. 18, 2000, pp. 165-170 XP0105017164.

* cited by examiner

Two-way semi- electronic scanning antenna application

APPLICATIONS FOR LOW PROFILE TWO WAY SATELLITE ANTENNA SYSTEM

CROSS REFERENCE TO RELATED APPLICATIONS

The present invention claims benefit under 35 USC §119 (e)(1) of U.S. Provisional Application No. 60/650,122 filed Feb. 7, 2005, and of U.S. Provisional Application No. 60/653,520, filed Feb. 17, 2005 and claims benefit under 35 USC §120 of the following United States applications in which this application is a continuation-in-part of U.S. application Ser. No. 11/074,754, filed Mar. 9, 2005; U.S. application Ser. No. 10/925,937, filed Aug. 26, 2004; U.S. application Ser. No. 11/071,440, filed Mar. 4, 2005; U.S. application Ser. No. 10/498,668, filed Jun. 10, 2004, now U.S. Pat. No. 6,995,712, issued Feb. 7, 2006; and PCT/US05/28507, filed Aug. 10, 2005. Each of the foregoing applications is hereby specifically incorporated by reference in their entirety herein. With respect to any definitions or defined terms used in the claims herein, to the extent that the terms are defined more narrowly in the applications incorporated by reference with respect to how the terms are defined in this application, the definitions in this application shall control.

TECHNICAL FIELD

The present invention relates generally to mobile antenna systems with steerable beams and more particularly to applications for low profile steerable antenna systems for use in satellite communications.

BACKGROUND

There is an ever increasing need for communications with satellites, including reception of satellite broadcasts such as television and data and transmission to satellites in vehicles such as trains, cars, SUVs etc. that are fitted with one or more receivers and/or transmitters, not only when the vehicle is stationary (such as during parking) but also when it is moving.

The known antenna systems for use for mobile Direct Broadcast Satellite (DBS) reception can be generally divided into several main types. One type utilizes a reflector or lens antenna with fully mechanical steering. Another type uses phased array antennas comprised of a plurality of radiating elements. The mechanically steerable reflector antenna has a relatively large volume and height, which, when enclosed in the necessary protective radome for mobile use, is too large and undesirable for some mobile applications, especially for ground vehicles. For use with in-motion applications, the antenna housing as a whole should be constrained to a relatively low height profile when mounted on a vehicle.

The array type comprises at least three sub-groups depending on the antenna beam steering means—fully electronic (such as the one disclosed in U.S. Pat. No. 5,886,671 Riemer et al.); fully mechanical; and combined electronic and mechanical steering. The present invention relates to the last two sub-groups.

Other patents related to antenna systems include U.S. Pat. Nos. 6,975,885, 6,067,453, 5,963,862, 5,963,862, 6,977,621, 6,950,061, 5,835,057, 5,835,057, 6,977,621, 6,653,981, 6,204,823 and U.S. Patent Publication: 20020167449.

Phased array antennas are built from a certain number of radiating elements displaced in planar or conformal lattice arrangement with suitable shape and size. They typically take the form of conformal or flat panels that utilize the available space more efficiently than reflector solutions and therefore can provide a lower height profile. In certain cases the mentioned panel arrangements can be divided into two or more smaller panels in order to reduce further the height, thereby rendering such arrangements more suitable for vehicles. Such an antenna for DBS receiving is described in A MOBILE 12 GHZ DBS TELEVISION RECEIVING SYSTEM, authored by Yasuhiro Ito and Shigeru Yamazaki in "IEEE Transactions on Broadcasting," Vol. 35, No. 1, March 1989 (hereinafter "the Ito et al. publication").

There is thus a need in the art to provide a mobile antenna system with low profile and better radiation pattern keeping relatively low cost, suitable for mounting on moving platforms where the size is an issue as is the case in RVs trains, SUVs, bus, boats etc.

BRIEF SUMMARY

This Summary is provided to introduce selected features of the invention more particularly described in the Detailed Description below. This Summary is not intended to limit the many inventions described in the Detailed Description but merely to highlight and simplify some of these inventions in a simplified context. The inventions are defined by the claims and the summary is not intended nor shall it be used to import limitations into the claims which are not contained therein.

In some aspects of the invention, a method may include applications of low profile mobile two-way satellite terminals and systems to military applications.

In still further aspects of the invention, the military applications shall include command and control application.

In further aspects of the invention, the military applications shall include medical applications.

In further aspects of the invention, the military applications shall include logistics applications.

In further aspects of the invention, the military applications shall include targeting applications.

In further aspects of the invention, the military applications shall include battle field control applications including targeting applications.

In still further aspects of the invention, the applications of the low profile two-way mobile satellite terminal shall include first responder applications.

In further aspects of the invention, the first responder applications shall include disaster relief applications.

In other aspects of the invention, the two way, low profile, mobile satellite terminal may be constructed and mounted for military applications.

In further aspects of the invention, the two way, low profile, mobile satellite terminal may be mounted to the roof of a cab of a vehicle.

In further aspects of the invention, the two way, low profile, mobile satellite terminal may be mounted to the turret of a tank behind the hatch.

In further aspects of the invention, the two way, low profile, mobile satellite terminal may be mounted to the back portion of the turret of a tank away from the cannon end.

In further aspects of the invention, the two way, low profile, mobile satellite terminal may be mounted to the flat top portion of the tank below the turret.

In further aspects of the invention, the two way, low profile, mobile satellite terminal may be mounted to the top of a humvee behind a gunners hatch.

In further aspects of the invention, the two way, low profile, mobile satellite terminal may be mounted to the roof of an ambulance.

In further aspects of the invention, the two way, low profile, mobile satellite terminal may be mounted to the top of a heliocopter in front of the tail section and behind the main cockpit.

In still further aspects of the invention, a antenna apparatus may include multiple network links to various aspects of the command and control structure.

In other aspects of the invention, the various aspects of the command and control structure include intelligence and logistics.

These and other aspects will be described in greater detail below. The invention is specifically contemplated as including any of the foregoing aspects of the invention in any combination or subcombination and may further include additional aspects of the invention from the text below in any combination or subcombination. In particular, when view in relation to the prior art cited herein, one skilled in the art will recognize numerous inventions from the description herein and this summary section is not limiting in as to the inventive concepts disclosed herein, which will only be defined by any final claims issuing in a patent.

BRIEF DESCRIPTION OF THE DRAWINGS

A more complete understanding of the features described herein and the advantages thereof may be acquired by referring to the following description by way of example in view of the accompanying drawings, in which like reference numbers indicate like features, and wherein.

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope and spirit of the present invention.

Figure 1:
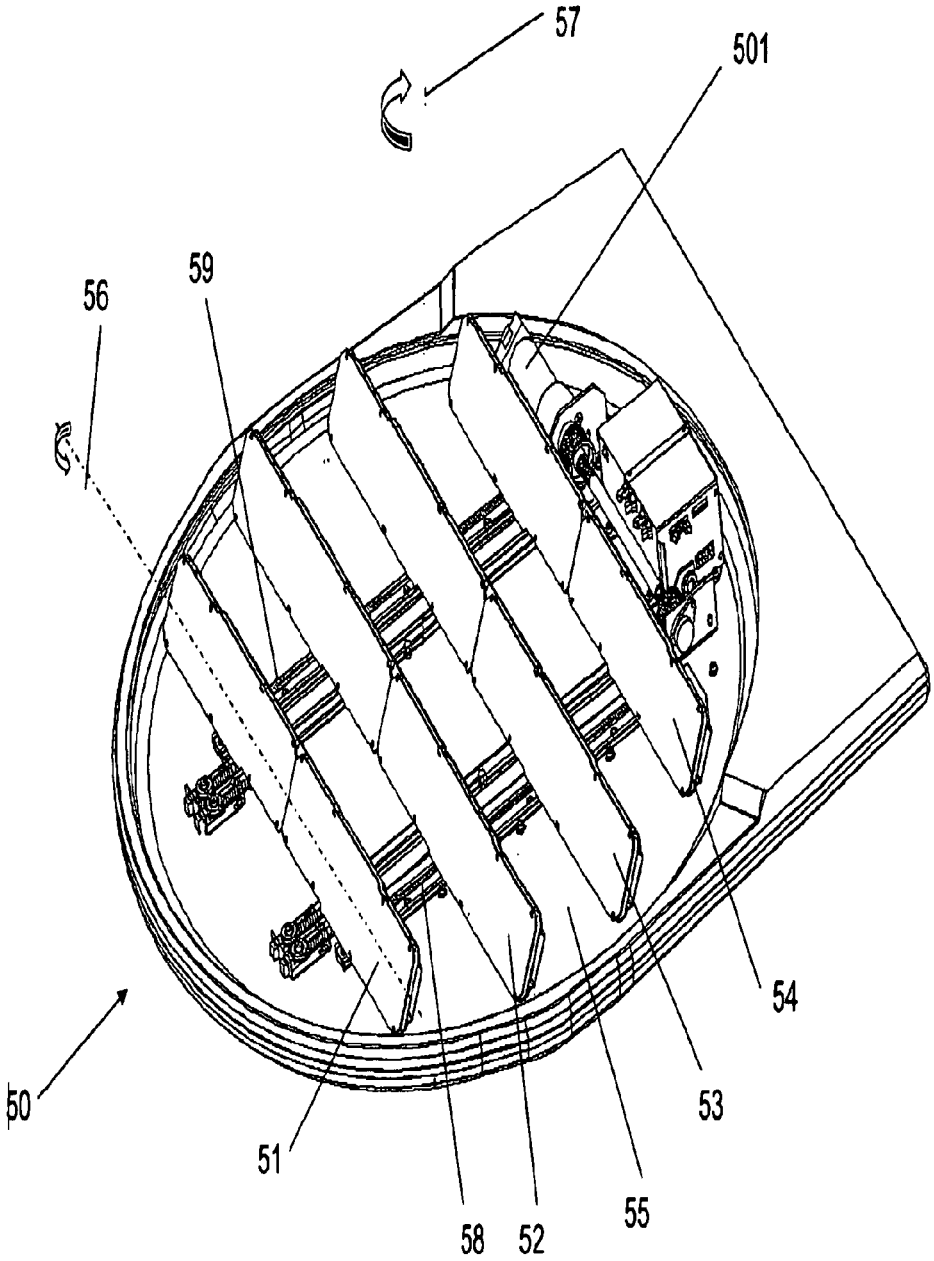
FIG. 1 illustrates an antenna unit in accordance with embodiments of the invention.
Figure 3A:
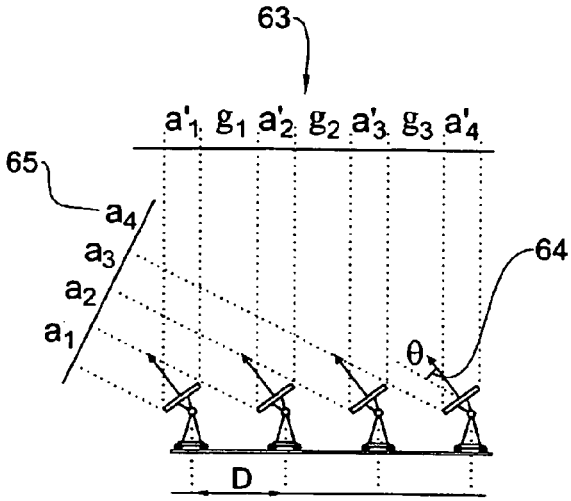
FIG. 3A-3C illustrate schematically a side view of an antenna unit in different elevation angles, in accordance with embodiments of the invention.
Figure 3B:
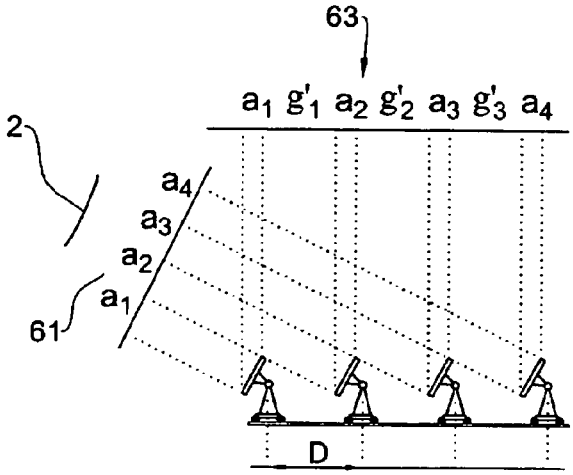
Figure 3C:
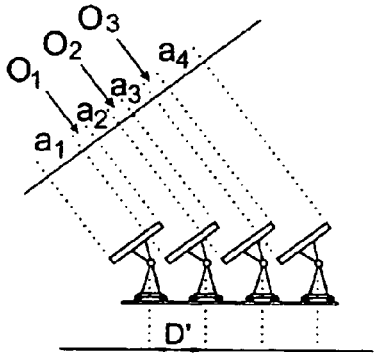

FIG. 1 illustrates a perspective view of an antenna unit 50, in accordance with an embodiment of the invention. In this exemplary embodiment, four antenna arrangements (51 to 54) may be mounted on a common rotary platform 55 using any suitable arrangement such as carriages/bearings disposed about at the center of each end of the antenna arrangement. In alternative embodiments, the antenna elements may be controlled using electronic steering such as a stepper motor, motor controller, angular rotation mechanism or other suitable arrangement. In the exemplary embodiment shown in FIG. 1, the carriages provide mechanical bearing for a traversal about an axis of rotation (see, for example, 56 marked in dashed line in FIG. 1) about perpendicular to the elevation plane of the antenna arrangement. In exemplary embodiments, the rotation of the antenna arrangement around the axis provides its elevation movement giving rise to different elevation angles as shown in FIGS. 3A to 3C. Although the elevation angles in this embodiment are provided via mechanical means, a lower profile at somewhat increased cost, may be achieved by using electronic steering of the elevation angles, thus eliminating the mechanical axis of rotation. This has the advantage of increasing reliability. This alternative embodiment is set forth more fully below.

The rotation in the azimuth plane may be realized by any suitable mechanism. Exemplary mechanisms include electronic steering which can increase costs but has the advantage of increasing reliability. The rotation in the azimuth plane may also be realized by rotating the rotary platform 55 about axis 57, typically disposed about normal thereto. Note that in this exemplary embodiment, the steering in the azimuth plane is performed mechanically using a mechanical driving mechanism, but electronic steerable antenna elements are also within the scope of the invention as more fully set forth below. It should be understood that the invention is, however, not bound by mechanical movement in the azimuth plane or in the elevation plane, again as more fully set forth below.

Returning to the elevation plane, in exemplary embodiments, the axes of rotation of two or more and/or all antenna arrangements may be disposed parallel each to other. For example, on the rotary platform 55 there may be mounted two rails 58 and 59 joined with the carriages, at their bottom side using a mechanical mechanism such as wheels or bearings. This may facilitate slide motion of the carriages in the rails 58 and 59. In this manner, a linear guided movement in direction perpendicular to the axes of rotation of the antenna arrangements may be achieved, to thereby modify the distance between the axes of the antenna arrangements (e.g. D, D1 and D2 shown in FIGS. 3A to 3C). An electrical motor with proper gears (not shown) may be provided for providing movement of the carriages in the rails. Note that the electrical motor and associated gears are a non-limiting example of driving mechanism and those skilled in the art will recognize other driving mechanisms. In still alternate embodiments, the drive motors and rails may be replaced by electrical switching a planar array antenna such that different elements disposed a different distance apart may be activated. The outputs of the selected elements may be input into the combining/splitting device to implement an electronic distance adjusting mechanism.

Antenna arrangements may be rotated around their respective transversal axes in a predetermined relationship with the elevation angle. Further, the antenna arrangements may be simultaneously moved back and forth changing the distance between each other, all as described in the applications incorporated by reference above.

Figure 2:
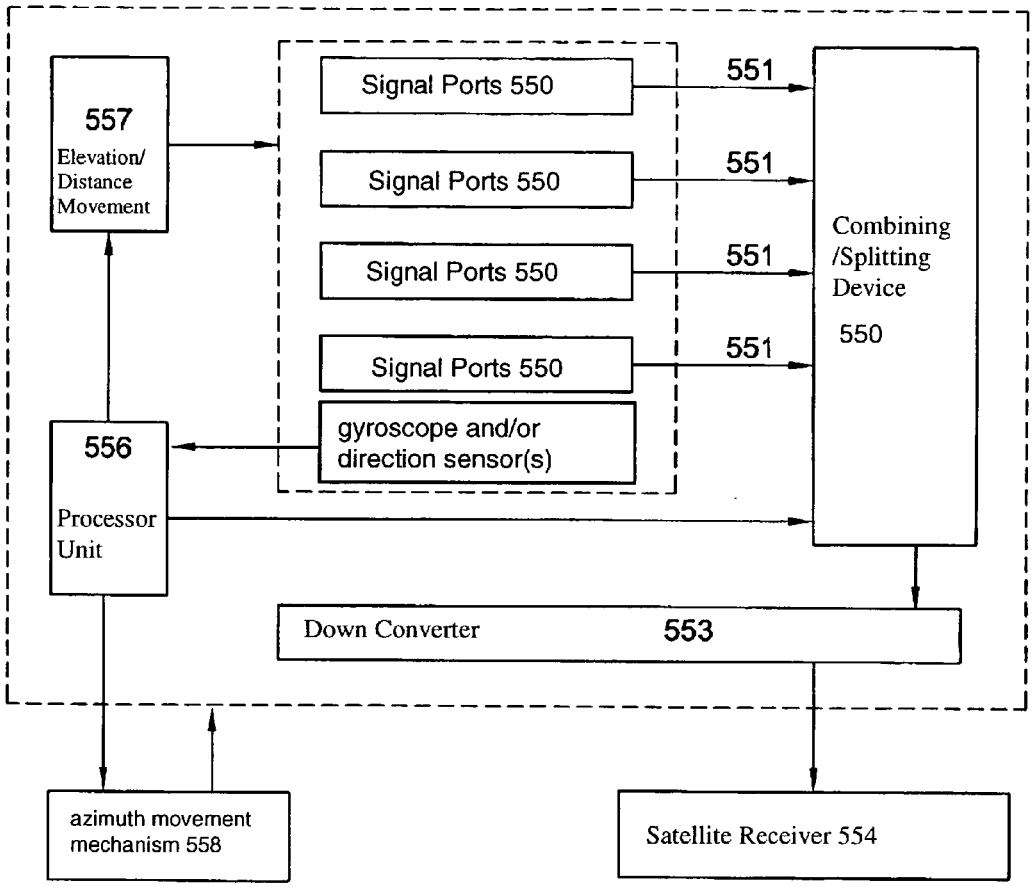
FIG. 2 illustrates a block diagram of a combining/splitting module in accordance with embodiments of the present inventions.

With respect to some embodiments as illustrated in FIG. 2, the antenna arrangements may have signal ports connected trough a connectivity mechanism 551, e.g. coaxial cables to a common RF combining/splitting device 552, which may provide combining/splitting of the signals, changing the phase or time delay for each antenna arrangement to combine the signals for each panel in a predetermined relationship with the tracking elevation angle and corresponding instantaneous distance between antenna arrangements and providing the combined/split signal to the down converter 553 and satellite receiver 554.

In exemplary embodiments, the antenna unit tracks the satellite (being an example of a tracked target) using directing and tracking techniques, for instance by using gyroscope and/or one or more direction sensor(s) 555, connected to the processor unit 556, which may be utilized to control elevation and distance movement mechanism 557, azimuth movement mechanism 558 and combining/splitting device 552 to direct the antenna at the satellite and/or in addition tracking the radio waves received from the satellite. Note that aspects of the invention are not bound by the specific configuration and/or manner of operation of FIG. 2.

Bearing this in mind, there follows a non limiting example concerning change of the distances between the axes (e.g. the specified D, D1 and D2 distances) performed in a predefined relationship with the elevation angle. More specifically by one example, the relationship complies with the following equation: 1 D=1 sin(e)*W, where D represents the distance between said axes of rotation of the arrangements, e may be the elevation angle and W may be the width of the arrangements' apertures. In this particular example, there are no gaps appearing for any elevation angle (as is the case for example with the specific examples depicted in FIGS. 3A-3C.

Turning now to FIG. 3A-C, there is shown, schematically a side view of an antenna unit with four antenna arrangements in different elevation angles, in accordance with an embodiment of the invention.

In one embodiment, the antenna arrangements (e.g. 51 to 54 of FIG. 1) are realized as planar phased array antennas (being an example of planar element array). By another embodiment, the arrangements are realized as conformal phased arrays (being an example of conformal element array). By still another embodiment, the arrangements are realized as e.g. reflector, lens or horn antennas. Other variants are applicable, all depending upon the particular application.

In some preferred embodiments for mobile applications, the antenna arrangements include one or more planar phased array antenna modules, acting together as one antenna. In accordance with certain embodiment of the invention, a reduced height of the antenna unit is achieved, thereby permitting a relatively low-height for the protective covering e.g., radome. For instance, for a satellite reception system operating at Ku-band (12 GHz) this could permit a low height antenna with height reduction to less than about 13 cm, or even less than about 10 cm (or even preferably less than about 8 cm). In the case of electronic steering of the antenna, a height of less than about 2 cm may be achieved. In one embodiment, the antenna has a diameter of 80 cm. (see 50 in FIG. 1), but this size may also be reduced to less than about ½ a meter and even less than about ⅓ of a meter. The reduced height and size of the antenna unit is achieved due the use of more antenna arrangements and the distance change between the arrangements, all as described above. The fact that more arrangements of smaller size are used and give rise to reduced height as is clearly illustrated in FIGS. 3A and 3C.

Note that the use of antenna arrangements of smaller size (in accordance with the invention) whilst not adversely affecting the antenna's performance may, in one embodiment, be brought about due to the use of variable distances between the antenna arrangements. Whenever necessary, additional optimizing techniques are used, all as described in detail above in the applications incorporated by reference. The use of antenna unit with reduced height, is an esthetic and practical advantage for a vehicle, such as train, SUV, RV, car, and has substantial benefits for military vehicles where the communication equipment is often targeted by an adversary.

Certain embodiments the antenna arrangements may be configured to provide transmit, receive or both modes. For example, array panels implemented for transmission at a suitable frequency, e.g. 14 GHz or at Ka-band (around 30 GHz) may be combined with those for reception, either on the same array panels, on different panels mounted to the same platform, or on a completely separate rotating platform. The tracking information for the transmit beam(s) could, in one example, be derived from the information received by the reception beam(s). The principles embodied herein would apply. If multiple transmit panels, separate from the receive panels, are used, the transmit panel spacings would be adjusted separately from those of the receive panels. If transmit and receive functions are combined on the same panels, the spacing criteria for the radiating elements and the inter-panel spacings can be derived from straightforward application of array antenna design principles and the panel spacing criteria described herein.

Figure 4:
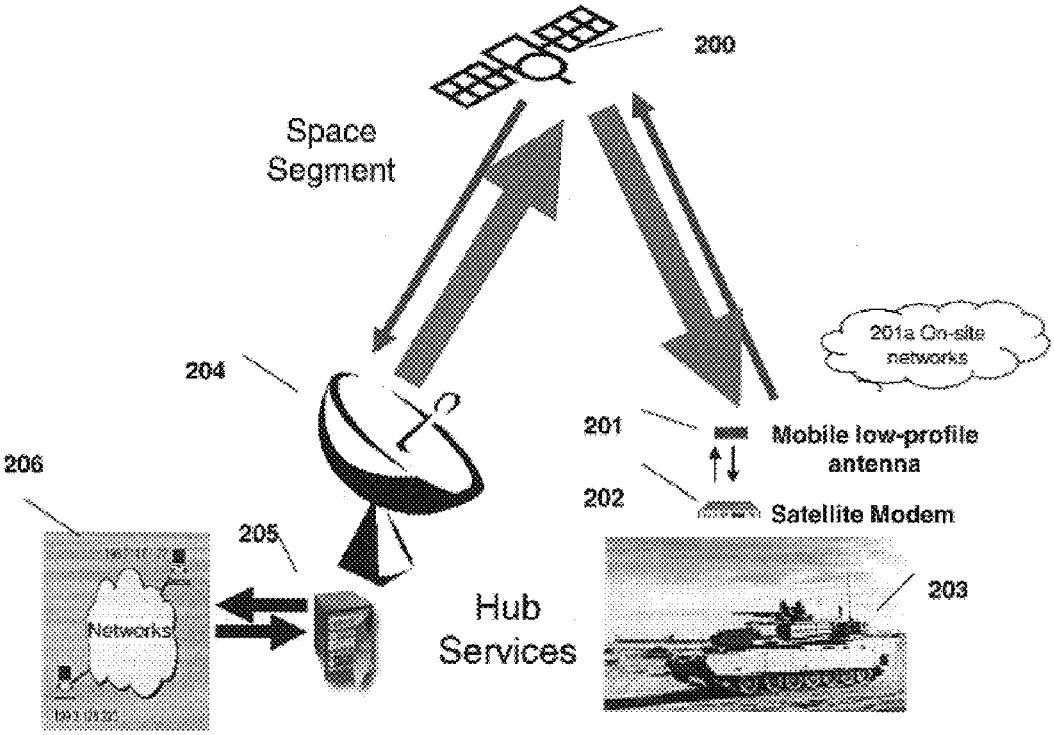
FIG. 4 is a diagram showing exemplary embodiments of the present invention.

The present invention comprises a terminal system using low profile transmit receive antenna, that is suitable for use with a variety of vehicles, for in-motion satellite communications in support of two way data transfer. With reference to the illustration in FIG. 4 of an exemplary system in which the invention may be employed, a mobile vehicle for example a tank 203 has mounted thereon a terminal system, comprising a low profile antenna terminal 201 and satellite modem 202, which communicate trough satellite 200 with a hub earth station 204. The satellite 200 may be a geostationary FSS, DBS or other service satellite working in Ku (or Ka) band or may be an end of life satellite on inclined orbit or a satellite arranged on low earth (LEO) or medium earth orbit (MEO) since the low profile antenna 201 is capable to track the satellite while in-motion and it is not needed satellite to stay fixed on the geostationary arc with respect to the antenna location on the earth surface. The earth station 204 supports the communication network, comprising many mobile terminals insuring processing information received and transmitted to mobile terminals as well as the interface with the terrestrial networks.

Figure 5:
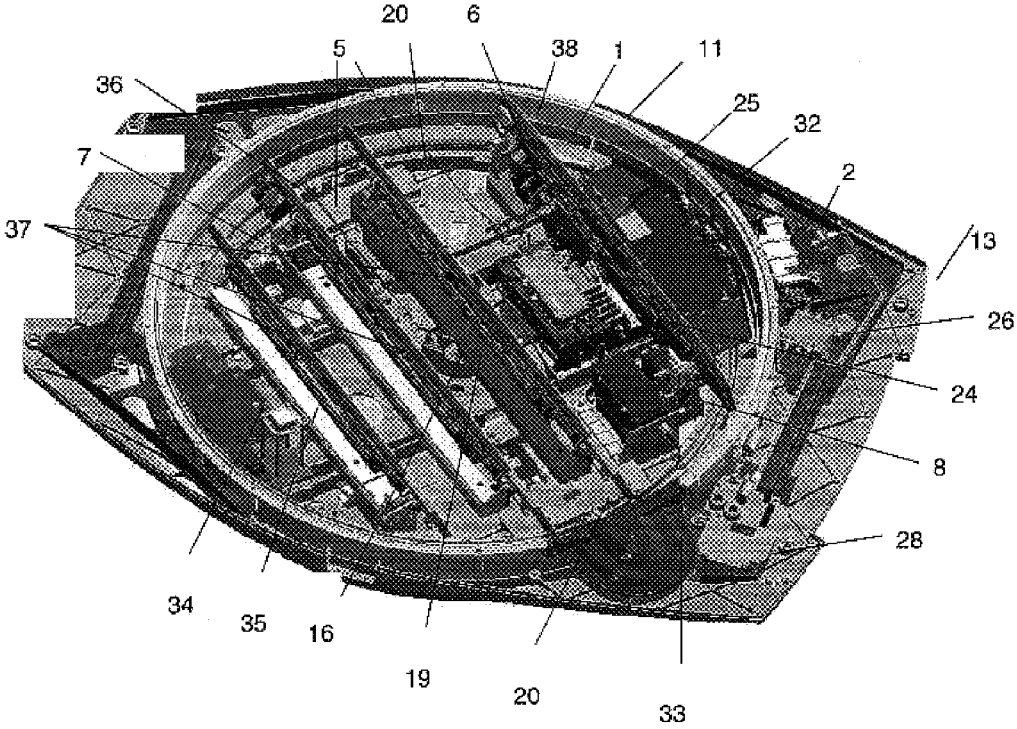
FIG. 5 illustrates a schematic view of an embodiment of the low profile two-way antenna outdoor unit.
Figure 6:
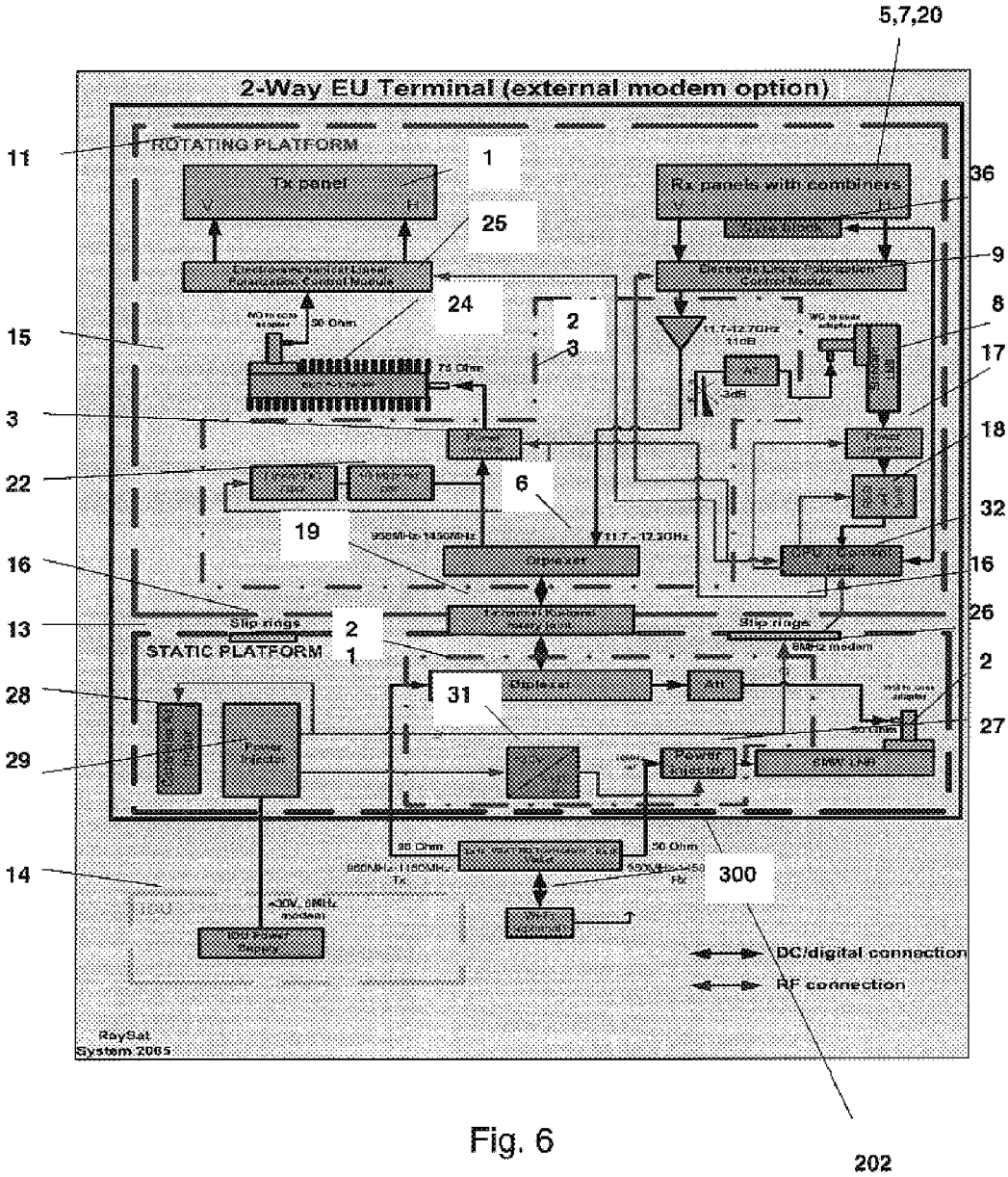
FIG. 6 is a block diagram of a two way terminal in embodiments having an external modem.

The example refers to a preferred application, namely low profile antenna terminal (shown on FIGS. 5, 6) for in motion two-way communication using satellites arranged on geostationary orbit or LEO or MEO orbits or end of life satellites on inclined orbit. While LEO and MEO orbits may be utilized, geostationary orbits may be preferred since there is substantial bandwidth available to the military and other organizations in the Ka and Ku bands. The preferred shape of the antenna build in the terminal comprises flat panels in order to decrease the overall height of the whole system. In one preferred application these could be several receive and transmit panels in order to optimize the size of the antenna aperture, which may be fitted in the specific volume with preferred minimal height. The terminal may include outdoor unit (ODU) 15 and indoor unit (IDU) 14. The IDU 15 comprises a rotating platform 11 and a static platform 13.

The outdoor unit may be variously configured and may include one or more of receive and transmit panels, phase combiners, global positioning system (GPS), received signal strength indicator (RSSI), diplexer(s), block up converter(s), elevation motor controller(s), central processing unit(s), rotary joint, gyro sensor block(s), azimuth motor and control board, low noise block(s), and power injector(s).

The rotating platform 11 may also be variously configured to include transmit (Tx) and receive (Rx) sections. The transmit section may include, for example, a flat and/or low profile antenna transmit panel 1, mechanical polarization control device 25 and up converter unit-block-up converter (BUC) 24.

The transmit antenna panel 1 may be variously configured to transmits signals with linear polarization. In this embodiment, a array antenna technology may be utilized which can comprise one or more dual port radiating elements (the antenna panel architecture and technology used are described in details in the patent application "Flat Mobile Antenna" PCT/BG/04/00011). In this embodiment, the antenna may be designed to work in transmit mode in the 14-14.5 GHz frequency band.

The signal power to each one of the two ports of the radiating elements may be delivered by two independent feeding networks one for all horizontal and one for all vertical radiating elements ports. The one or more independent feeding networks (e.g., two) are connected to the outputs of the polarization control device 25 in order to achieve the needed amplitude and phase combination of the signals delivered to each one of the two ports. In this example, the radiating elements may be configured to match the polarization tilt angle of the transmitted signal with the polarization of the receiving antenna situated on the satellite. In exemplary embodiments, the feeding networks comprise properly combined stripline and waveguide power splitting devices in order to minimize signal losses. The block up converter 24 may be configured to include up-converting circuit, a high power amplifier up-converting, and/or amplifying the transmit signal with intermediate frequency. In exemplary embodiments, these may operate in the L band with the satellite modem 202. In another application, one or more high power amplifying modules may be integrated directly to each one of the transmit panel inputs in order to minimize signal losses between any up-converter unit(s) and radiating element(s). In this case a mechanical and/or electronic polarization control device connected between the up-converter and power amplification units may be used. The electronic polarization control may comprise suitable circuitry such as electronic controlled phase controlling devices and attenuators in order to control the amplitude and phase of the signals applied to each one of the antenna panel inputs.

The Receive section may be variously configured. For example, the receive section may include multi panel receive antenna. Where multi panel receive antenna are utilized, they may include one or more "large" 5 and/or "small" 7 antenna panels. Where a rotating platform is used, the multi panel may be situated on the same rotating platform with the transmit panel 1 and aligned properly to have either exactly and/or about the same directions of the main beams. In this manner, the panels 5 and 7 have an extended frequency band of operation in order to simultaneously cover both FSS (11.7-12.2 GHz) and DBS (12.2-12.7 GHz) bands.

Where mechanical elevation controls are utilized, the elevation angles and/or the distances between the receive panels may be controlled by the elevation mechanics and elevation controlling motors 37. These devices may be variously arranged such as on the backs of the receiving panels 5,7 in order to achieve best performance in the whole elevation scan range. One embodiment of such a construction including its principles of operation and construction of the multi-panel antenna receive system are disclosed in the patent application U.S. Ser. No. 10/752,088 Mobile Antenna System for Satellite Communications, herein incorporated by reference. In another application, the distances between receiving panels may be optimized for a given range of elevation angles and stay fixed in order to simplify the elevation controlled mechanics. However, fixed distances may result in degradation in the reception performance.

In still further embodiments, one or more combining and phasing blocks 20 (for example, two where each one is dedicated to one of the two independent linear polarizations), may be utilized to properly phase and combine the signals coming from the antenna panels outputs. Polarization control device 9 may be utilized to control and match the polarization offset of the linearly polarized FSS signals with respect to the satellite position. In another preferable application the combining and phasing blocks 20 may be used to provide the needed signal polarization tilt, which could obsolete the need of additional polarization control device 9.

A low cost gyro sensor block 36 in some embodiments may be variously placed, i.e., on the one of the receive panel's backs and may be utilized to provide information about the platform movement to the digital control unit 32. The digital control unit 32 controls all motors for beam steering in azimuth and elevation, polarization controlling devices 25 and 9, phase combining and phase control blocks 20, comprising interfaces to the gyro sensor block 36 and indoor unit 14. In another preferable application an additional gyro sensor 38 may be attached to the back of the transmit panel 1 in order to provide information about the dynamic tilt angle of the platform needed for the dynamic correction of the polarization mismatch error.

In another preferable application a GPS receiving module 35 may be used to provide information of the exact position of the antenna to the CPU block 32. The information may be variously used, for example to calculate the exact elevation angle with respect to the one preferred for the communication satellite. It may also be used to reduce the initial time needed for satellite acquisition. In another preferable application, the information may be used for the calculation of the signal polarization tilt, given the information for geographical position of the antenna provided by the GPS module 35 and the position of the preferred for communication satellite.

The diplexer and power injector unit 23 may be variously configured and may include a diplexer 6 for splitting intermediate frequency transmit signal in L band and high frequency receive signal in Ku band delivered through the common broadband rotary joint device 19, power injector 3 biasing the BUC device 24 and a internal 10 MHz reference source. In another preferred application the reference source may be delivered by the satellite modem 202.

The static platform comprises DC sleep rings 16 in order to transfer DC and digital control signals to the rotating platform, static part of the RF rotary joint 19, azimuthally movement mechanics, azimuth motor 33, the azimuth motor controller 28, diplexer and power injector unit 26, and LNB 2 down converting the received signal. The diplexer and power injector unit 26, comprises diplexer 21 combining the IF transmit signal in L band and received high frequency signal in Ku band to transfer through the same broadband rotary joint 19, power injector 27 providing bias to the LNB 2 and voltage inverting circuit 31.

Indoor unit 14 may be variously configured to include power supply unit biasing Outdoor unit 201. In another application, the indoor unit may be combined with the satellite modem 202 and a WiFi interface 300 with the communication equipment installed in the vehicle. It may also communicate with equipment and personnel external to the vehicle, for example, located within 3000 feet from the vehicle. In this manner, a subnet may be established.

Figure 7:
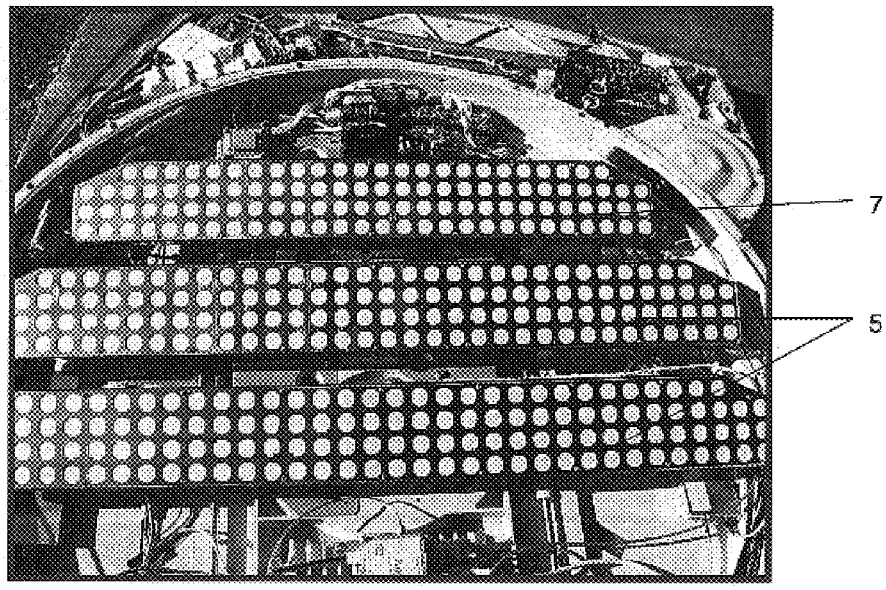
FIG. 7 is an illustration of receive panels which may be utilized in an outdoor unit.

FIG. 7 illustrates an example of receiving flat antenna panels. In one preferred embodiment of the invention, two large 5 and one small 7 panels are used. The panels may be variously configured such as comprising a plurality of radiating two port antenna elements arranged in a Cartesian grid, two independent combined stripline-waveguide combining circuits. The combining circuits may be configured to combine independently the signals received by the horizontal and vertical excitation probes of all panel radiation elements, providing the summed signals to two independent panel outputs. They may also be configured to combine the signals further, coming from the panel's outputs with properly adjusted phase and amplitude by combining and phasing blocks 20. In another preferred embodiment in polarization control module 9 it is possible to select the preferred application signal polarization. The polarization could de circular—Left Hand (LHCP) or Right Hand (RHCP) or linear—vertical (V) or horizontal (H) or tilted linear at any angle between 0 and +/−90 degrees.

Figure 8:
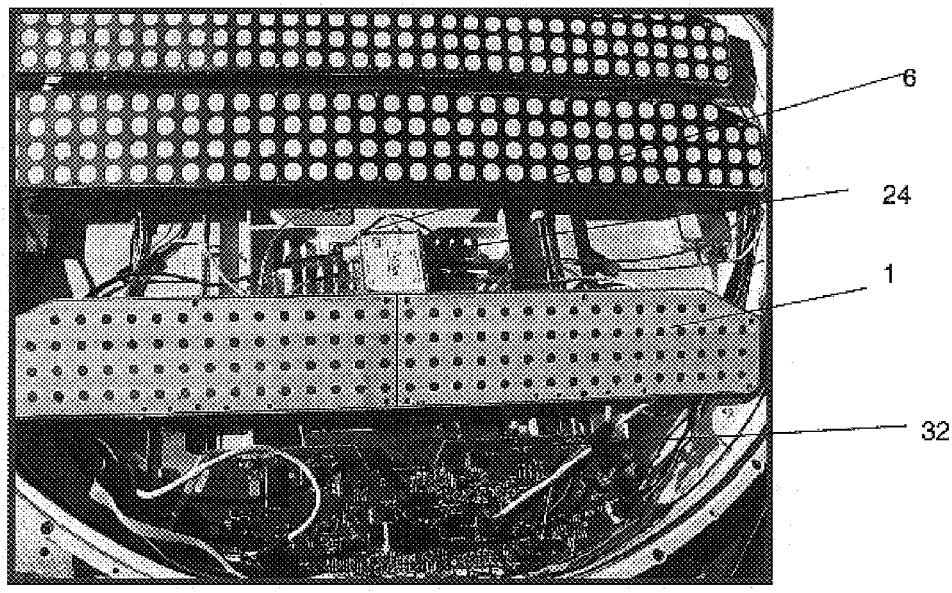
FIG. 8 is an illustration of a transmit panel in combination with a plurality of receive panels which may be utilized in an outdoor unit.

FIG. 8 illustrates an example of the transmit panel 1. In the shown embodiment, the transmit panel comprises plurality of patch radiating elements. In others preferred embodiments, the radiating elements maybe radiating apertures, dipoles, slot or other type of low directivity small size antennas.

Figure 9:
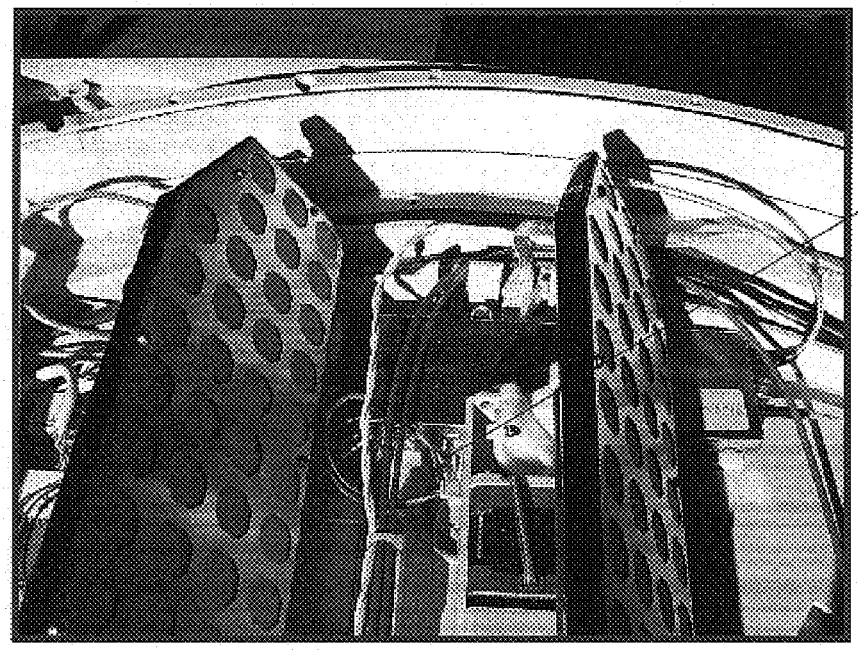
FIGS. 9 and 10 show H and V signal phase combiners which may be utilized in embodiments of the outdoor unit.
Figure 10:
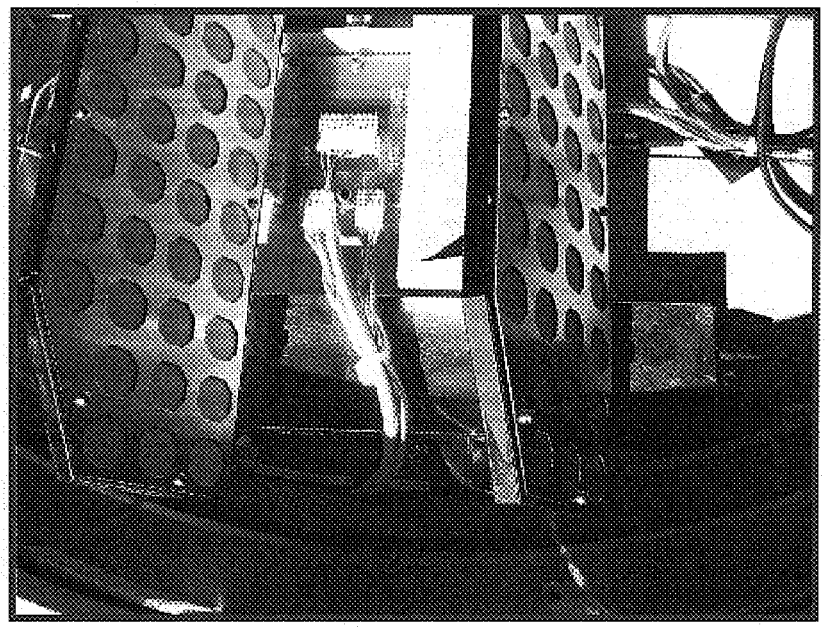

FIG. 9 illustrates an example of an elevation mechanic and elevation motor 37. In the embodiment shown, the elevation control to each one of the panels (transmit and receive) is provided using a separate step motor arranged on the back of the panel and a proper elevation mechanic. In another application, a common motor for the elevation movement of all antenna panels may be used. The elevation mechanics in case of the application should provide the possibility to synchronize the elevation movement of all panels.

Figure 11:
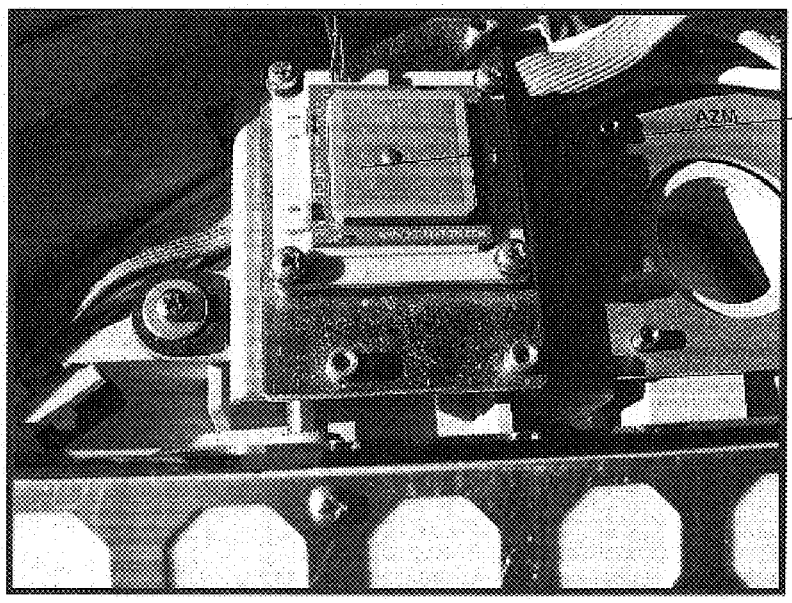
FIG. 11 is an illustration of an exemplary embodiment of a global positioning system.
Figure 12:
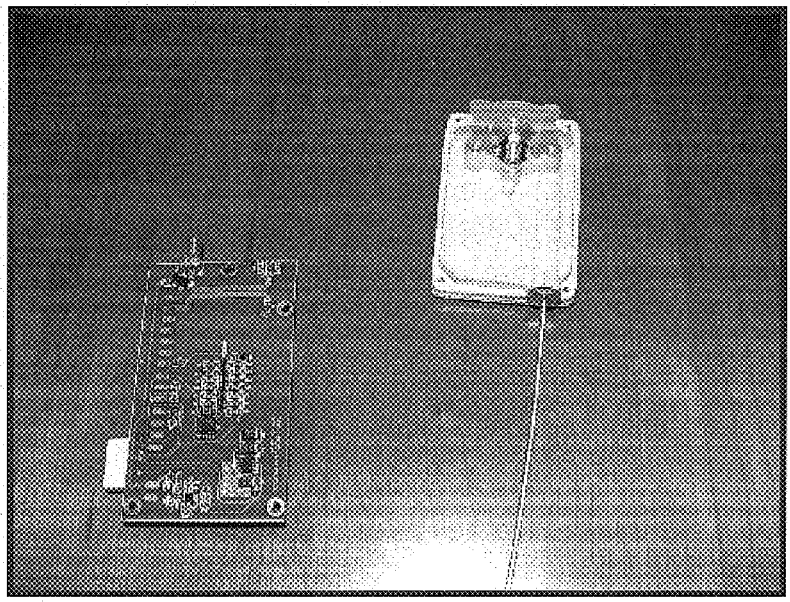
FIG. 12 is an illustration of an exemplary embodiment of a received signal strength indicator.

FIG. 11 illustrates an example of a GPS module 35. In the example, the module provides information about current geographical position of the antenna to the main CPU board 32. The information may then be used for calculation of the elevation position of the satellite in order to minimize the initial acquisition time. In another application, the information may be used to calculate the polarization tilt corresponding to the position of the antenna and the position of the preferred communication satellite.

Figure 13:
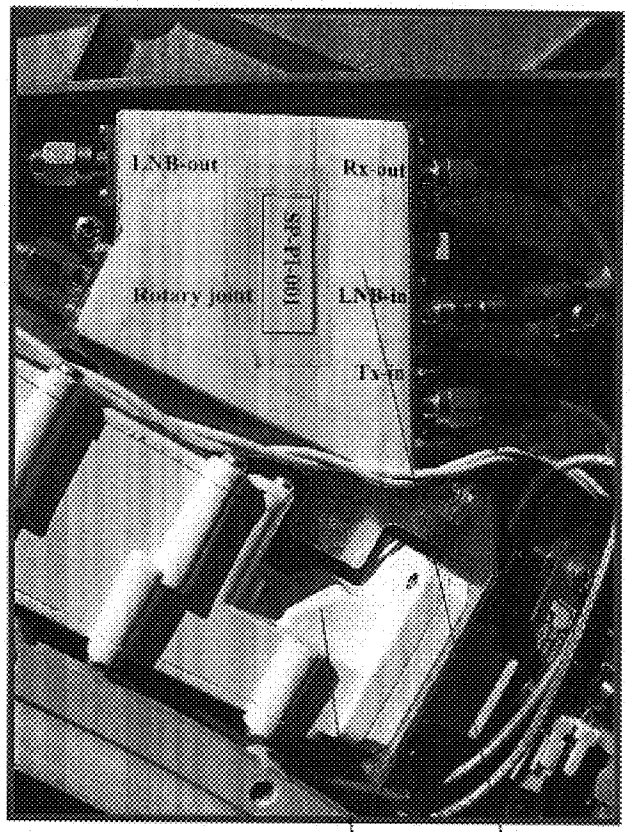
FIG. 13 is an exemplary duplexer which may be utilized in the outdoor unit to allow transmit and receive signals to be carried on the same cable.

FIG. 13 illustrates an example of a static platform. In this example, the diplexer and power injector device 26 may include diplexer 21, power injector 27 and voltage converter 31. In this example, the diplexer 21 combines the intermediate transmit signal in L band and high frequency received signal in Ku band. This configuration may facilitate the transfer between rotating and static platforms using the single broadband rotary joint 19. In this way, the diplexer may provide the transmit signal, having intermediate frequency in L band through rotary joint to the block-up converter 24, situated on the rotary platform and in the same time Ku band received signal to the LNB 2.

Figure 14:
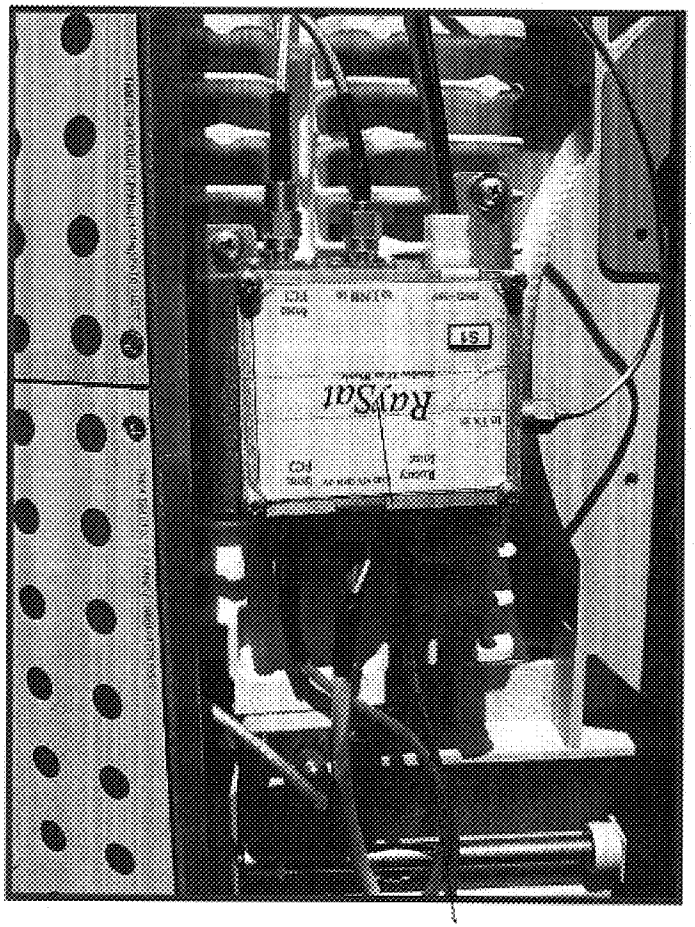
FIG. 14 is an illustration of an exemplary embodiment of a block up converter.

FIG. 14 illustrates an example of the diplexer and power injector device of the exemplary rotating platform 23. The diplexer and power injector device comprises diplexer 6, power injector 3 and internal 10 MHz reference source 22. The diplexer 6 combines the intermediate transmit signal in L band and high frequency received signal in Ku band in order to be transferred between rotating and static platforms using one and the same broadband rotary joint 19.

Figure 15:
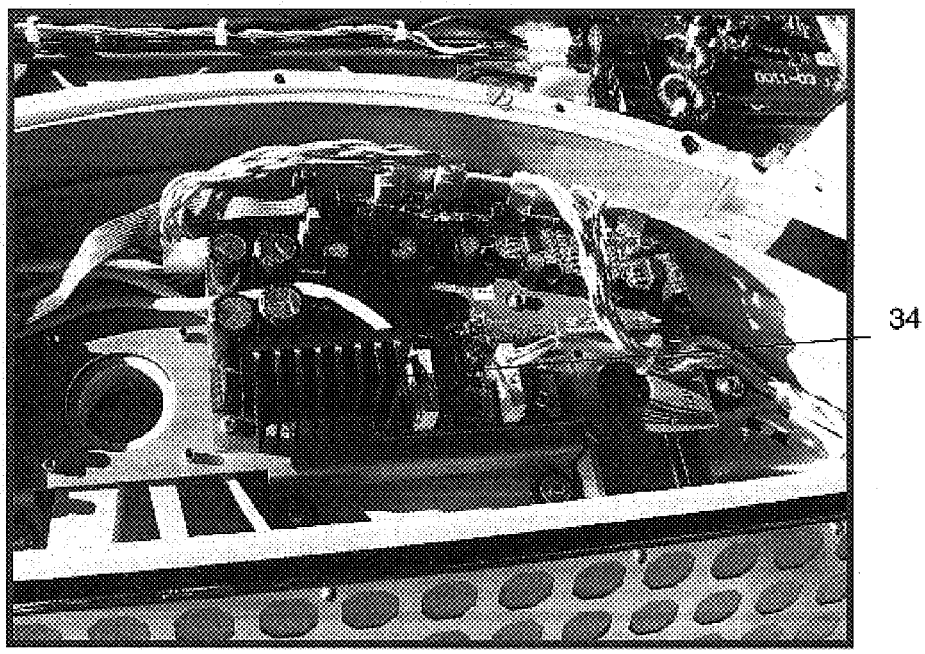
FIG. 15 is an illustration of an exemplary embodiment of a elevation motors controller.

FIG. 15 illustrates an example of an azimuth motor control board.

Figure 16:
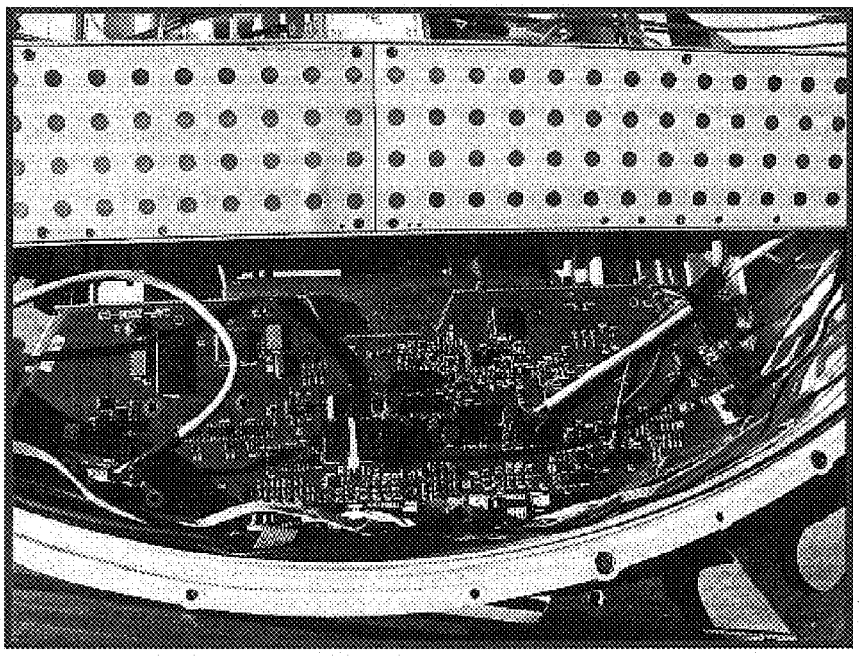
FIG. 16 is an illustration of an exemplary embodiment of a central processing unit module for use in connection with the outdoor unit.

FIG. 16 illustrates an example of a CPU board.

Figure 17:
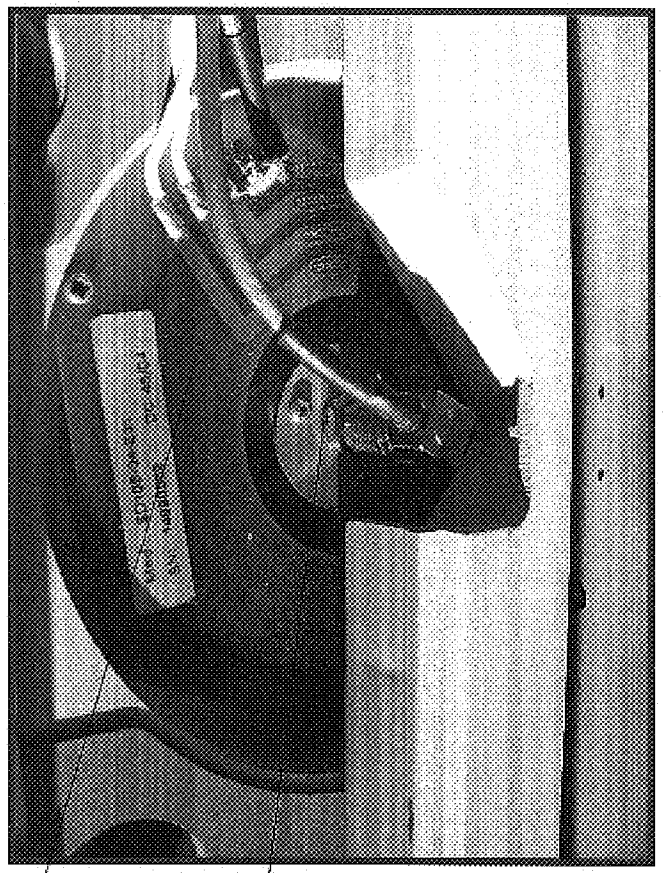
FIG. 17 is an illustration of an exemplary embodiment of an outdoor unit rotary joint for use with outdoor units which employ a mechanical rotary joint as opposed to an electronic direction mechanism.
Figure 18:
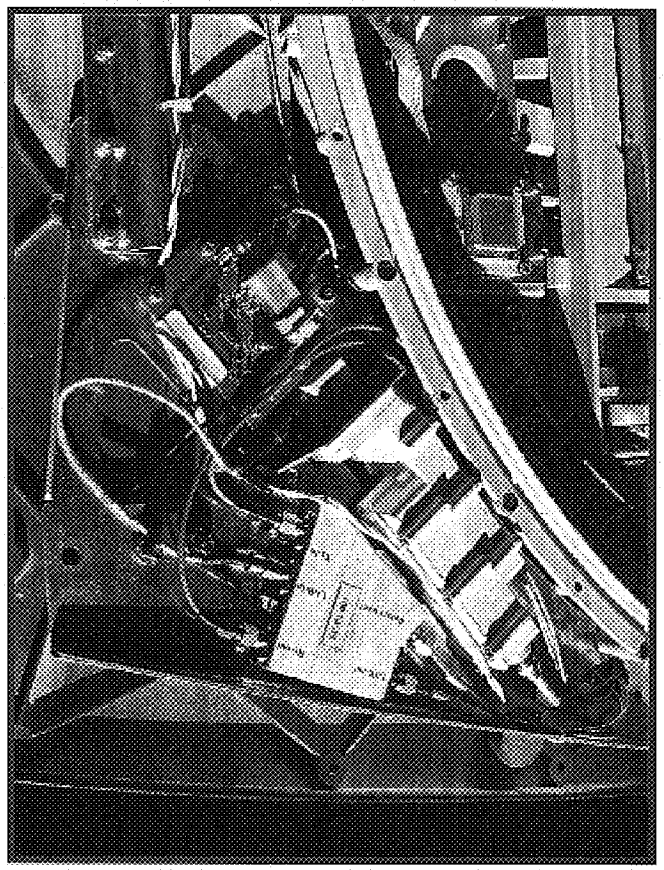
FIG. 18 is an illustration of an exemplary low noise block and power injector.

FIG. 17 illustrates an example of a broadband rotary join device 19. The rotary joint provides RF connection between rotating 11 and stationary platforms 13 of the antenna terminal. The RF connection comprises transmit signal with intermediate frequency in L band and high frequency received signal in Ku and/or Ka band. The slip rings 16 provide the DC and digital signal connections between rotating 11 and stationary 13 platforms. In embodiments where electronic steering is utilized, no rotary joint may be required.

Figure 19:
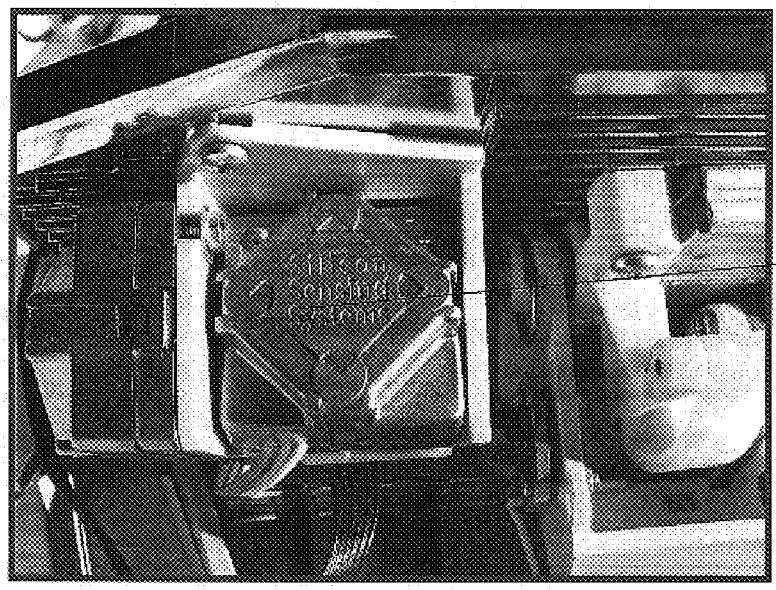
FIG. 19 is an illustration of an exemplary gyro sensor block.

FIG. 19 illustrates an example of the gyro sensor block 6. The gyro sensor block comprises two gyro sensors providing the information for platform rotation in azimuth and elevation.

Figure 20:
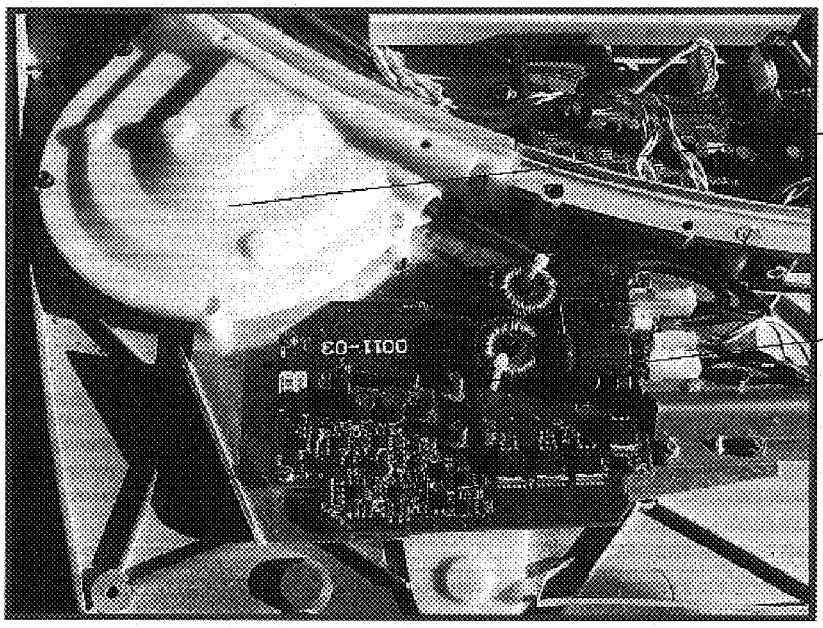
FIG. 20 is an illustration of an exemplary azimuth motor and azimuth control board.

FIG. 20 illustrates an example of an azimuth motor 33 and azimuth motor control board 28.

The components shown in detail in FIGS. 5-21 may be integrated into one or more application specific integrated circuits. In particular, integration of the electronics into one or more application specific integrated circuits reduces costs and increases reliability. This can have significant advantages particularly when deployed across many vehicles in price sensitive applications or deployed in harsh environments such as military applications.

Figure 21:
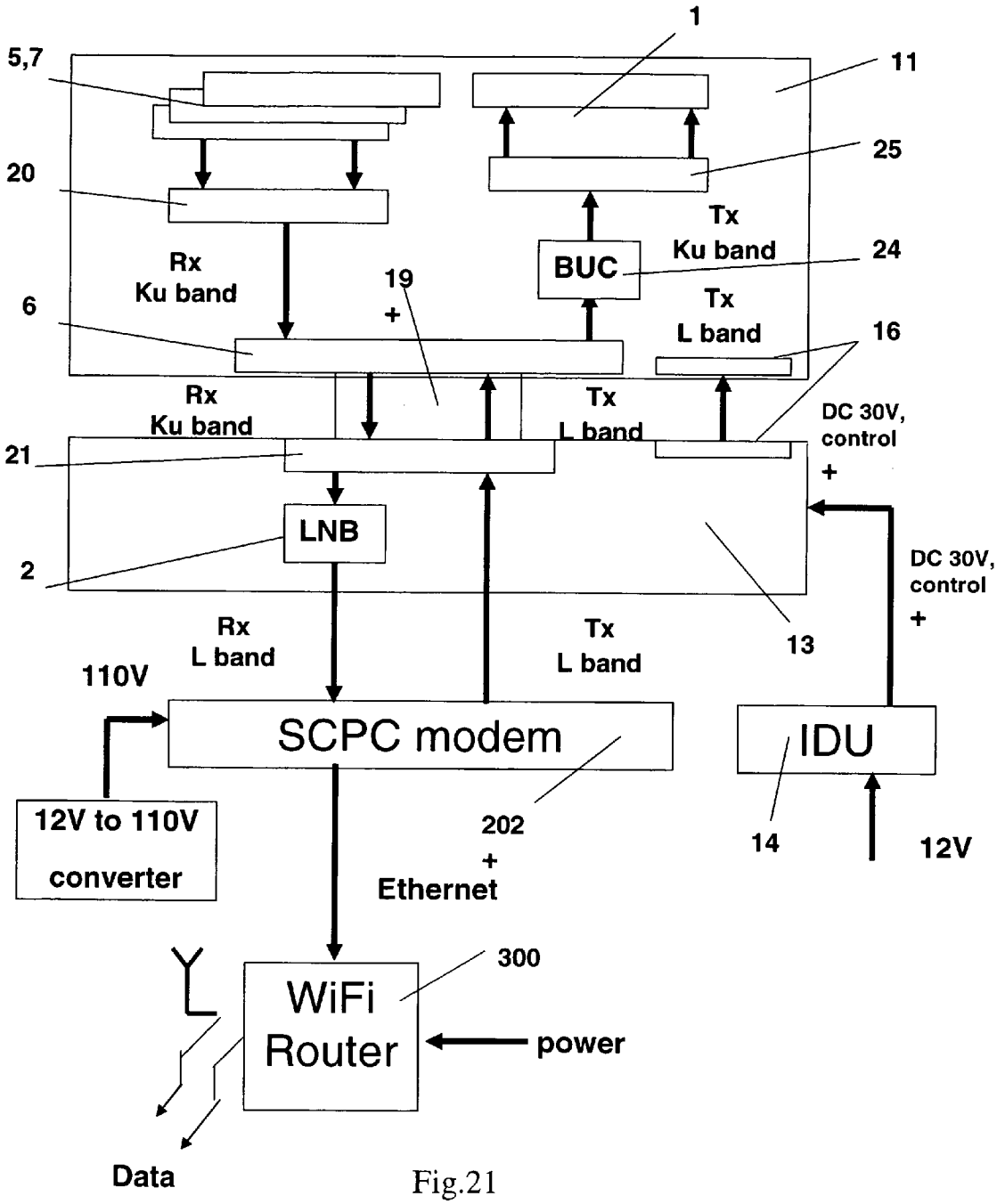
FIG. 21 is a block diagram of a low profile two way satellite antenna in accordance with some aspects of the present invention.

FIG. 21 is schematic illustration of an exemplary embodiment of the signal flow through various components on the Rx and Tx sides, including an illustration of signal transferring between rotary and static platforms of the ODU through a single broadband rotary joint. In this example, the Rx signal goes out from the output of the received active panels 5,7. The signals may then be combined by the active combining devices 20. In this example, the combining is in parallel with proper phase and amplitude of the Rx signals set in order to achieve the desired polarization tilt. Again in this example, the signal is combined with the intermediate frequency Tx signal in L band in the diplexer 6 and transferred trough the single broadband rotary joint 19 to the static platform 13. On the static platform 13 the Ku band Rx signal may be separated from the Tx L band signal by the diplexer 21 and down converted by a LNB 2 to an intermediate frequency in L band. The intermediate Rx signal may then be transferred by a separate coaxial cable to the satellite modem 202 in the vehicle. From the other side in this example, the Tx signal coming from the satellite modem 202 with an intermediate frequency in L band is transferred through a cable to the static platform 13 and then combined with the Rx signal in Ku band in the diplexer 21 in order to be transferred through the common broadband rotary joint 19 to the rotating platform 11. On the rotating platform 11 again in this example, the Tx signal is separated from the Ku band Rx signal using the diplexer 6 and then upconverted by a BUC 24 in Ku band. Continuing with the example, the upconverted Tx signal may be transferred through the polarization control device 25 in order to adjust the polarization tilt. The Tx signal may then be delivered to the transmit antenna inputs.

Figure 22:
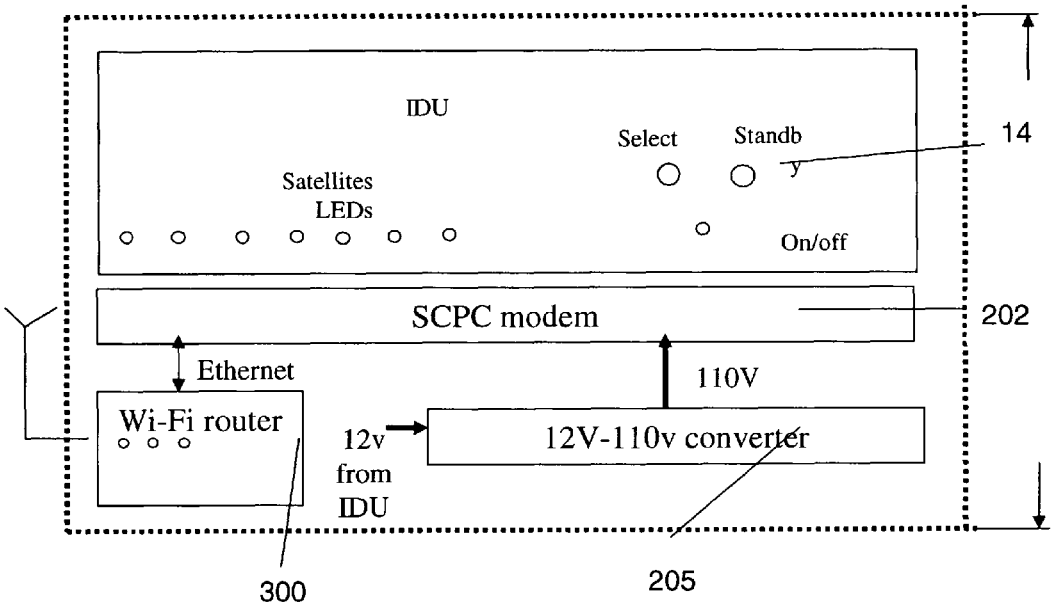
FIG. 22 is a block/illustrative diagram of an assembly which may function as an indoor unit for the low profile two-way satellite antenna illustrated in FIG. 21.

FIG. 22 illustrates an example of the equipment which may be disposed inside the vehicle according to the embodiment of the invention. The equipment in this example comprises an Indoor unit 14, Satellite modem 202, WiFi router 300 and/or Voltage converter 205. The Indoor unit 14 may be variously configured such as providing the bias voltage to the Outdoor unit and control signal for the selection of the satellite preferred for communication. In the example, the satellite modem processes the digital communication signal, coming from the computer or other communication devices and transfers them to Rx and Tx intermediate signals in L band. In one preferred application, a WiFi router 300 may be used for a wireless interface with the computer or other communication equipment. In the example, the voltage converter 205 is an off-the-shelf device for transferring 12V DC power supply from the vehicle battery to 110V AC used to power the satellite modem 202. Of course, a 12 or 24 volt system could also be utilized.

Figure 28:
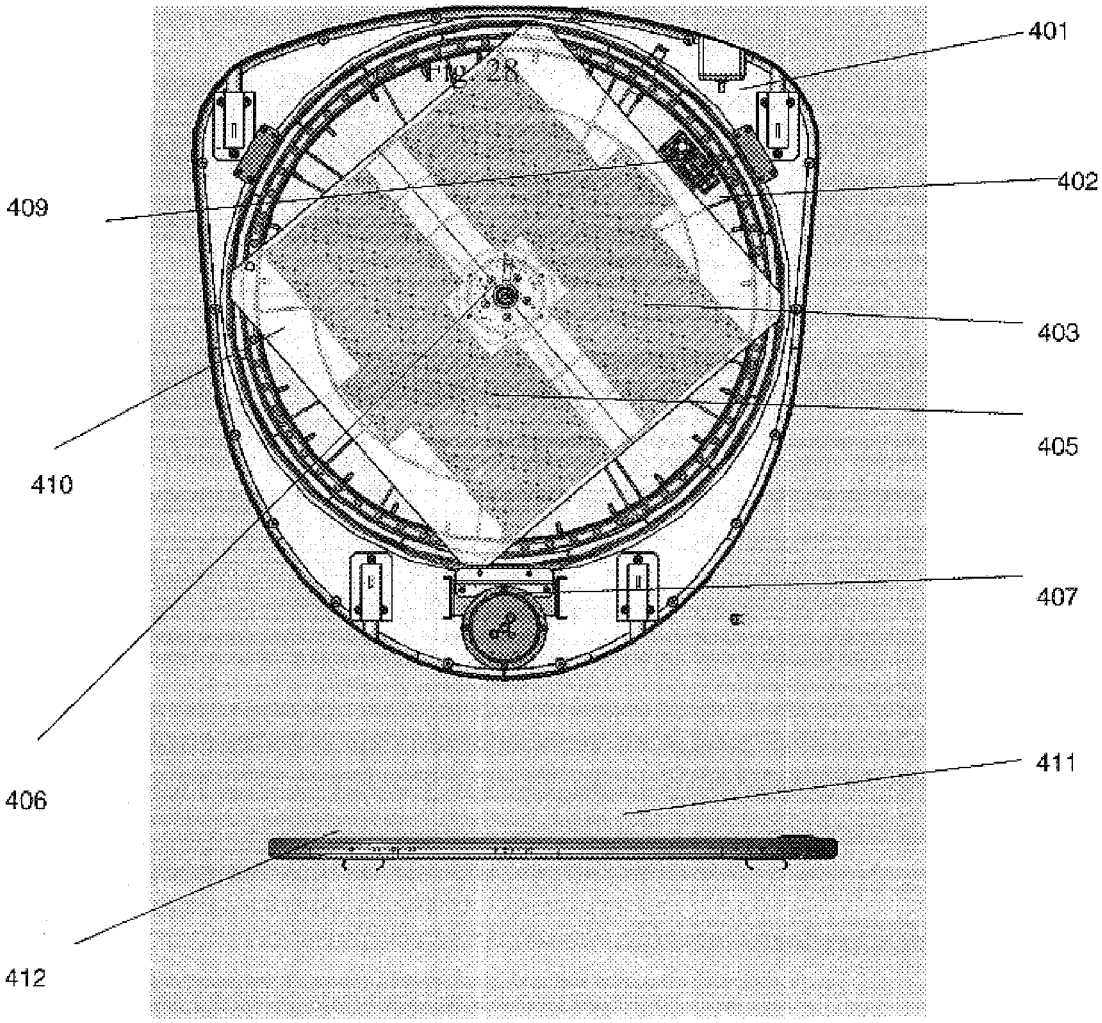
FIG. 28 is a two way semi-electronic scanning antenna.
Figure 29:
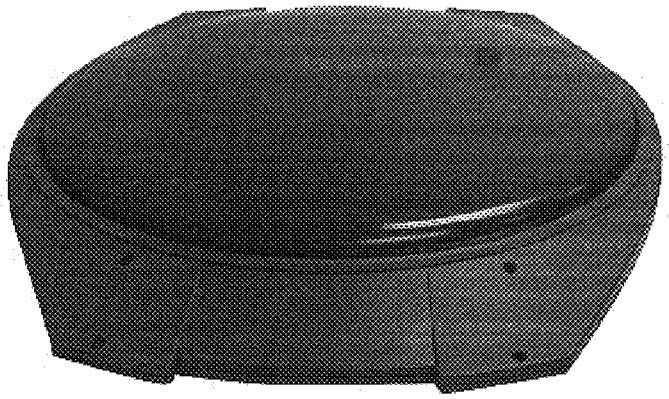
FIG. 29 is an exemplary embodiment of a low profile antenna.
Figure 30:
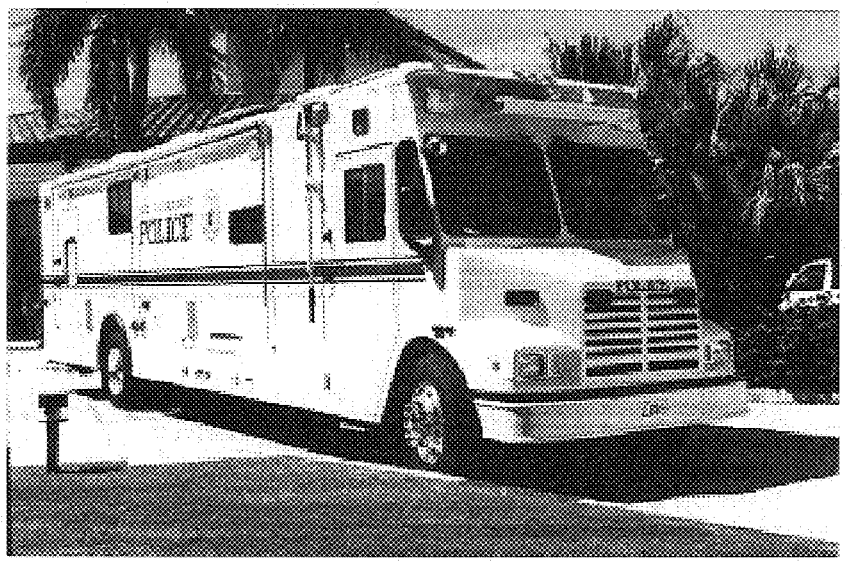
FIG. 30-31 are exemplary embodiments of a low profile antenna outfitted to mobile command centers.
Figure 31:
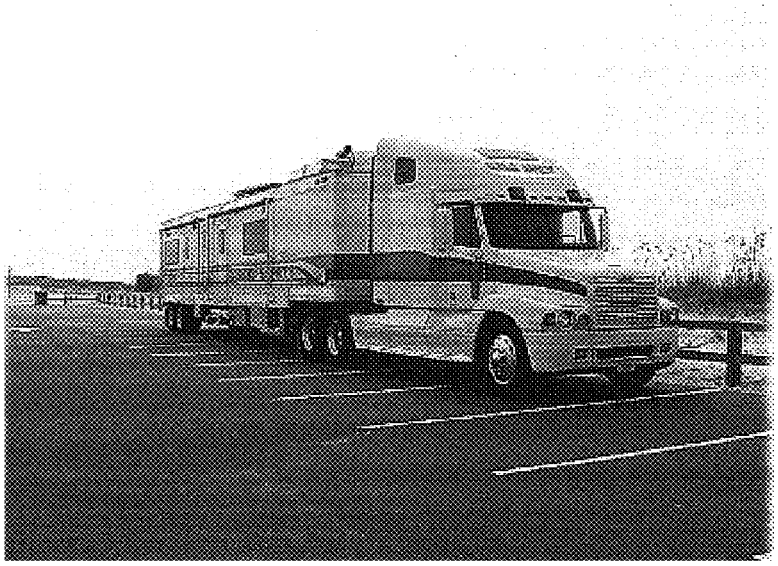
Figure 32:
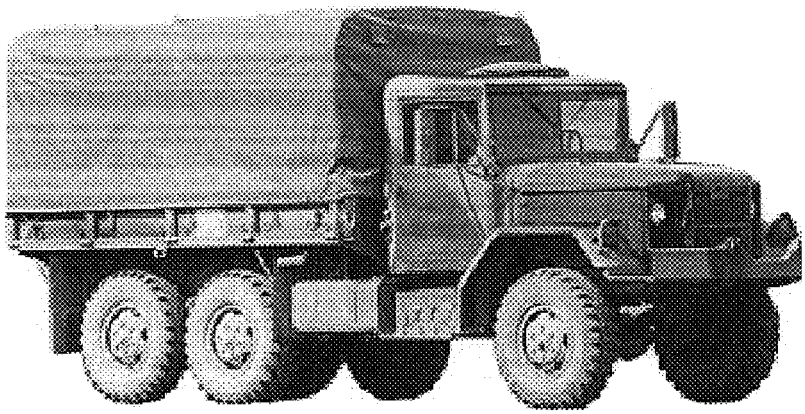
FIGS. 32-34 and 36-38 are illustrative embodiments of a low profile antenna mounted to various military vehicles.
Figure 33:
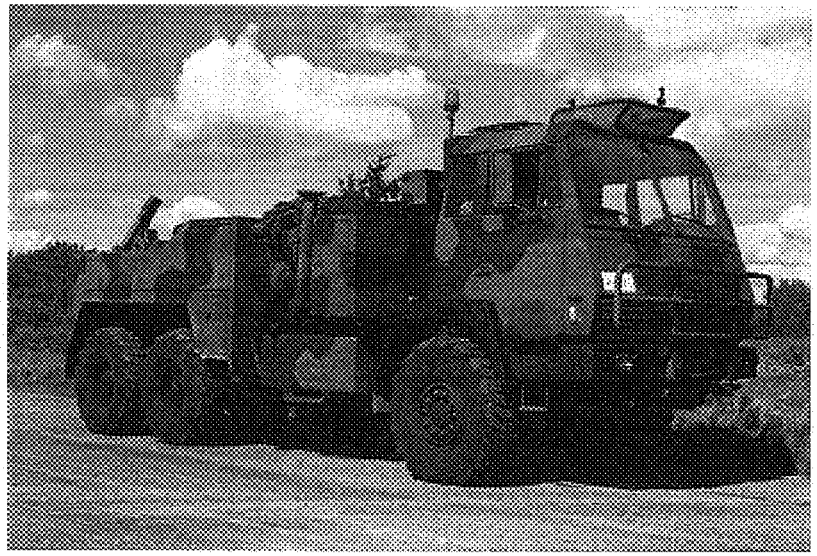
Figure 34:
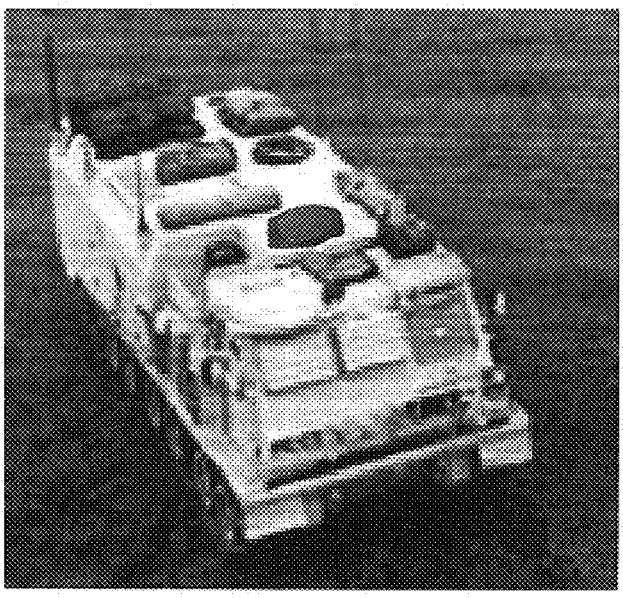
Figure 35:
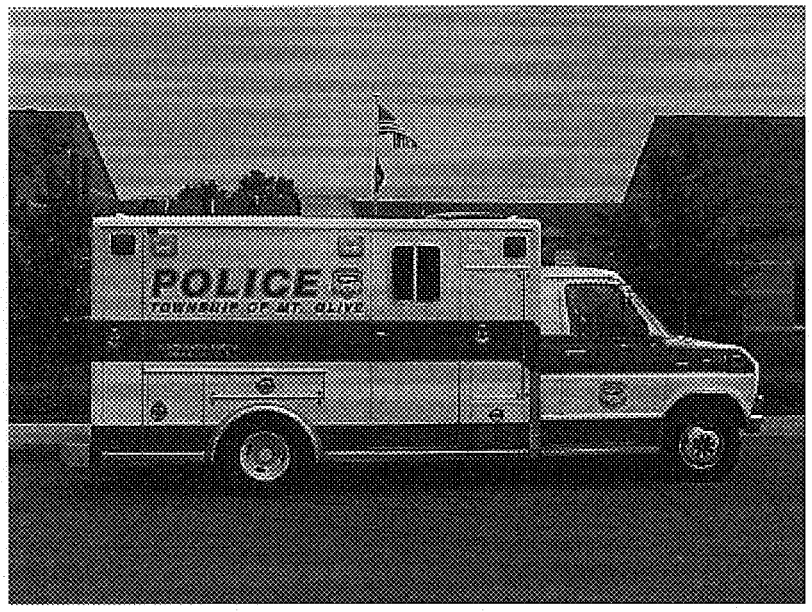
FIG. 35 is an illustrative embodiment of a low profile antenna mounted to a police/ambulance/emergency response team.
Figure 36:
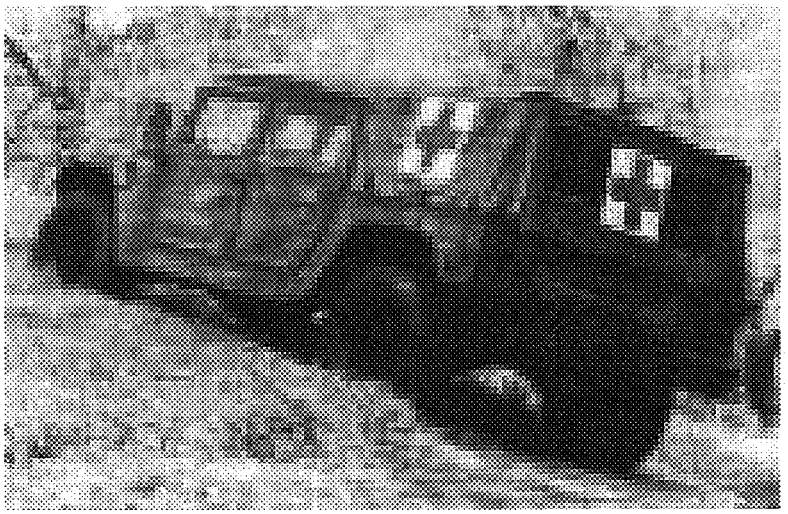
Figure 37:
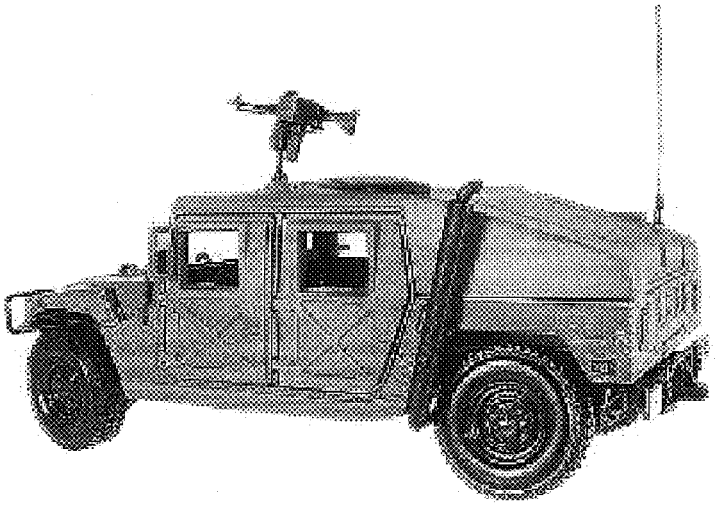
Figure 38:
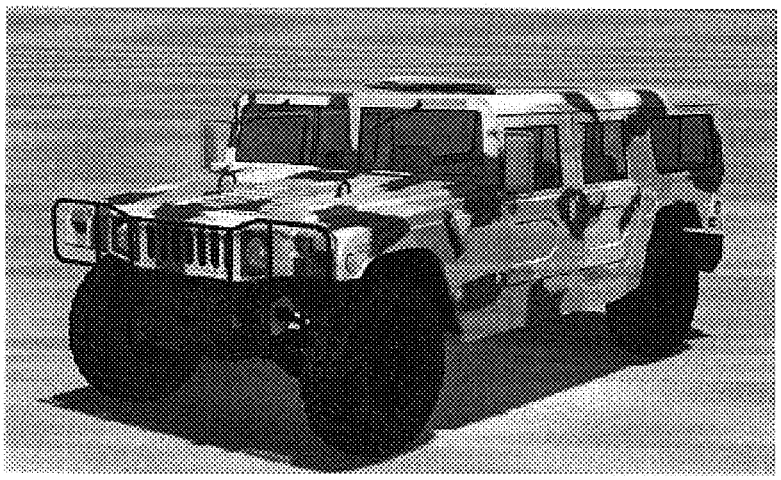

FIG. 28 illustrates one preferred application of a semi-electronic scanning antenna. The antenna beam is steered electronically in elevation and mechanically in azimuth. In this example, antenna may be flat on the vehicle roof, reducing the overall height of the antenna terminal (below 2.5"). In this example, the antenna terminal comprises static platform (antenna case base) 401 and rotating platform 402. An antenna panel 410 may be situated on the rotating platform 402. The antenna panel 410 comprises two array antenna apertures: receive antenna aperture 403 and transmit antenna aperture 405. In another embodiment, the same array antenna aperture is utilized for transmit and receive and may include a plurality of broadband radiating antenna elements. The antenna panel 410 may be configured to include several flat layers which comprises radiating antenna elements, combined microstip/waveguide low loss combining networks, amplifiers, phase controlling devices, up and down low-profile converters, gyro sensors and digital control unit. In these embodiments, since the antenna may scan electronically only in the elevation plane, the radiating elements may be grouped initially by rows. In this manner, the system may apply the phase control to the entire row in the process of scanning, reducing significantly the number of amplifiers and phase controlling devices (compared with the full electronically steering option).

In another exemplary embodiment, when the field of view in the elevation plane is limited to 50-60 degrees, it is possible to combine two rows, which may benefit from the additional reduction of the number of amplifiers and phase controlling devices. In one embodiment, the static platform 401 comprises azimuth motor and azimuth motor controller 407, power supply unit 409 and a static part of the rotary joint 406. In another embodiment the static platform 401 may comprise GPS modules gyro sensors, digital control unit or block-up converter. The static 401 and rotating 402 platforms may or may not be connected through rotary joint 406. Where a rotary joint is used, the rotary joint 406 provides transmit and receive signals, power supply and digital control signals. In one preferred application a dual rotary joint may be used to provide transmit and receive signals between the two platforms independently, and slip ring for DC and digital signals. The static platform (antenna case base) may also include antenna radom 411 attachment mechanics and a set of brackets 412 for proper mounting on the vehicle roof. The antenna radom 411 provides a proper environment protection as well as an antenna shielding against small arms attacks.

Two-Way Full Electronic Scanning Antenna Application

Another embodiment is a fully electronic scanning antenna. The antenna comprises the plurality of radiating element, feeding networks, amplifiers and phase controlling devices, which are able to control properly the phase of each one of the antenna radiating elements in order to achieve full electronic beam steering. The full electronically scanning antenna may comprise two independent receive and transmit array antenna apertures or in another preferred embodiment to have one and the same antenna aperture for transmit and receive comprising the plurality of broadband antenna elements. The antenna terminals in case of full electronically steered antenna may include a multilayer antenna panel and antenna box. The antenna box may comprise a radom for environmental protection and for proper mounting on the vehicles. Where a multi-layer antenna panel is utilized, it may include all antenna electronic parts. The radiation antenna elements may be arranged on the top layer of the antenna panel, while the feeding networks and low noise amplifiers are situated on the intermediate layers. In one embodiment, the phase controlling devices, final combining networks, and low profile down and up converting devices are arranged on the bottom layer of the antenna panel. In another embodiment, the antenna panel comprises the digital control unit, gyro sensors and GPS module. The exemplary embodiments described above may be configured to enable a fully electronic steerable antenna is much more reliable, since it does not include any moving parts. Another important advantage of the preferred application is the highest possible speed of tracking limited only by the speed of electronics.

Ruggedization for Military Applications

A consideration for military applications is the radom design and ruggedization. For military applications, it is often useful to use special materials and designs. One example is the use of LEXAN plastic. RaySat has employed a variation of this design for train environments. The material is very strong and has a good transparency for RF signal. By increasing the thinkness, the LEXAN plastic may be designed to be thick enough and correspondingly very strong (around quarter wavelength 6-8 mm in Ku band). The thickness may be selected to account for the best tradeoff with respect to different frequencies used in the transmit and receive, since the frequencies are in different bands 11.9-12.7 for Rx and 14-14.5 for Tx. Another embodiment is to use more expensive radoms, specially designed for military applications based on plastic with ceramic filing or other proper materials. LEXAN material may be used in the bullet protection jackets. Similar other materials with good bullet protection and satellite signal transparency may also be used.

Two antennas on a single vehicle may be used to improve the reliability of the system. Something in addition, if the distance between antennas is large enough (having in mind application on the long vehicles, buses, trains etc.), it will reduce significantly the communication interruptions due to the shadowing (blockage) from buildings, trees and other obstacles.

Further, spread spectrum may be implemented dependent on the satellite modem utilized. If spread spectrum is utilized, it may be accommodations may need to be made to accommodate more vehicles such as increasing the number of transponder frequencies.

Speed of Tracking

The system as it is now could easily achieve a tracking speed of 40 deg/s in elevation and 60 deg/sec in azimuth, which is more than enough for tank applications. For military application it is important to implement dynamic adjustment of the polarization tilt when the tank is driving over rough terrain. For that purpose a third gyro on the back of the transmit panel may be utilized implemented. The gyro may provide the CPU information for the dynamic tilt change compensation due to the vehicle movement around the axes normal to the surface of the antenna panels. The initial polarization tilt angle (when the vehicle is standing of a flat horizontal surface) is calculated by CPU having the information for the geographical position of the antenna, provided by GPS module and the position of the satellite preferred for communication.

In exemplary embodiments, the Antenna may be mounted in a way that provides a clear view to all elevation and azimuth angles covering the desired field of view. In one embodiment, a good way to connect the terminal with the equipment inside the vehicle is a cable connection. The described configuration may use 2 RF cables (for Rx and Tx) connection with the satellite modem and one additional cable for DC and digital communication with the indoor unit. Wireless connection can be problematic in certain military environments and could be detected relatively easily by the enemy reconnaissance.

Applications of Low Profile Two-Way Ku and/or Ka Band Antennas

Figure 23:
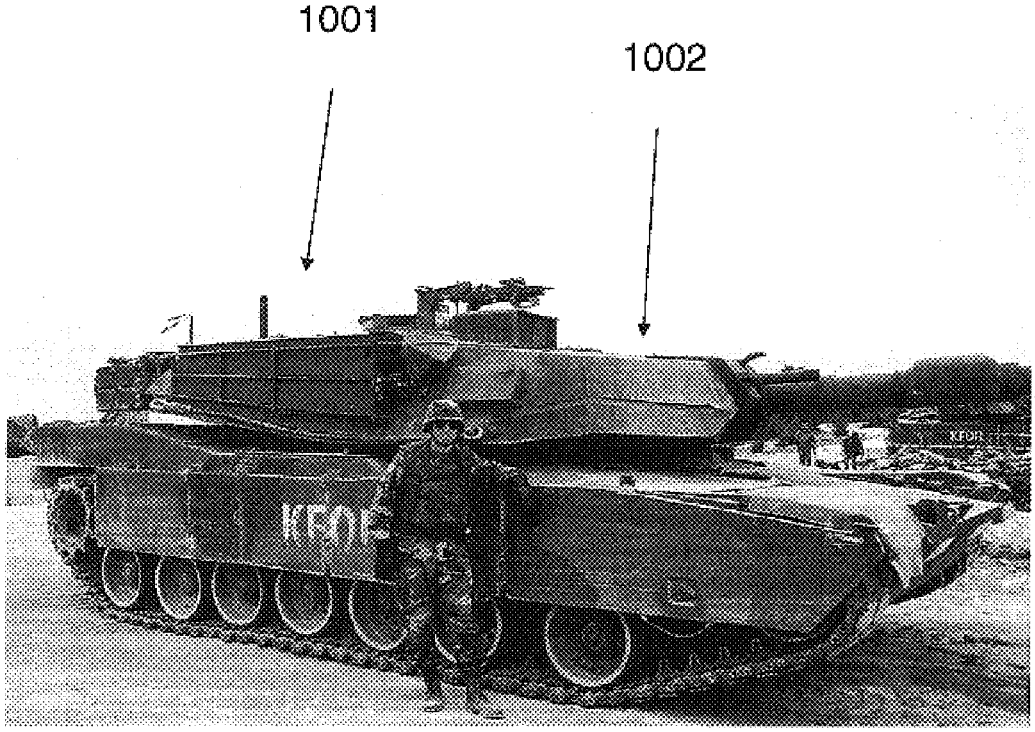
FIGS. 23-24 illustrate various places the low profile two-way satellite antenna may be placed on a tank (e.g., an Abrams tank)
Figure 24:
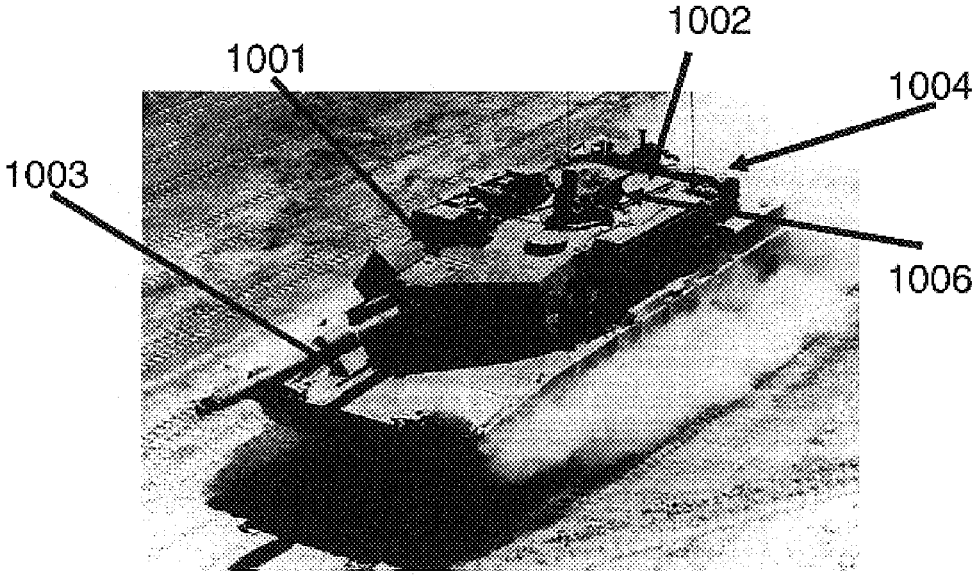
Figure 25:
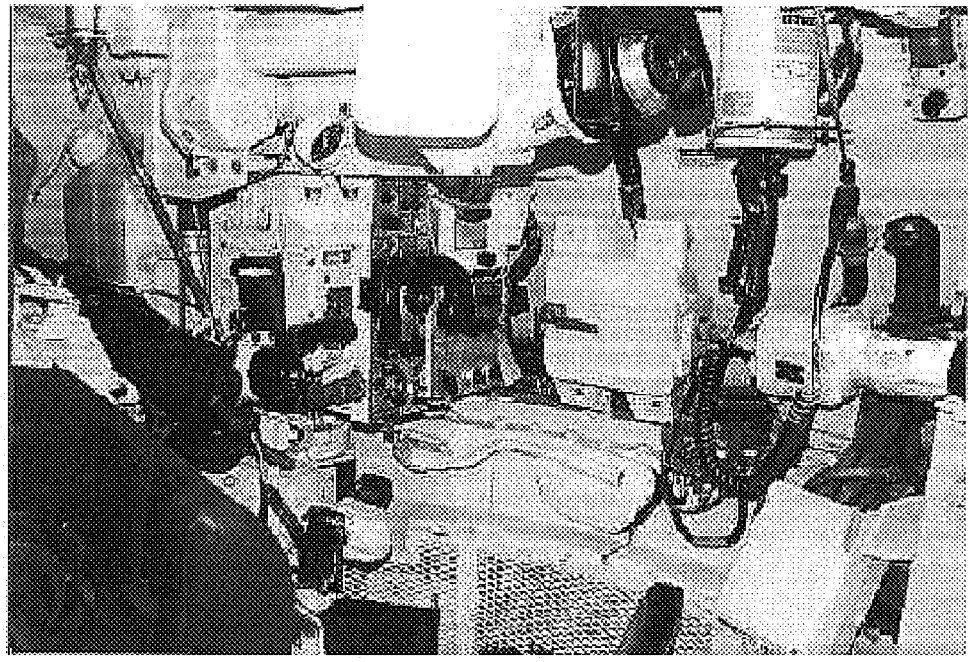
FIG. 25 illustrates an exemplary gunners station in an Abrams tank which may be retrofitted with embodiments of the present invention.
Figure 26:
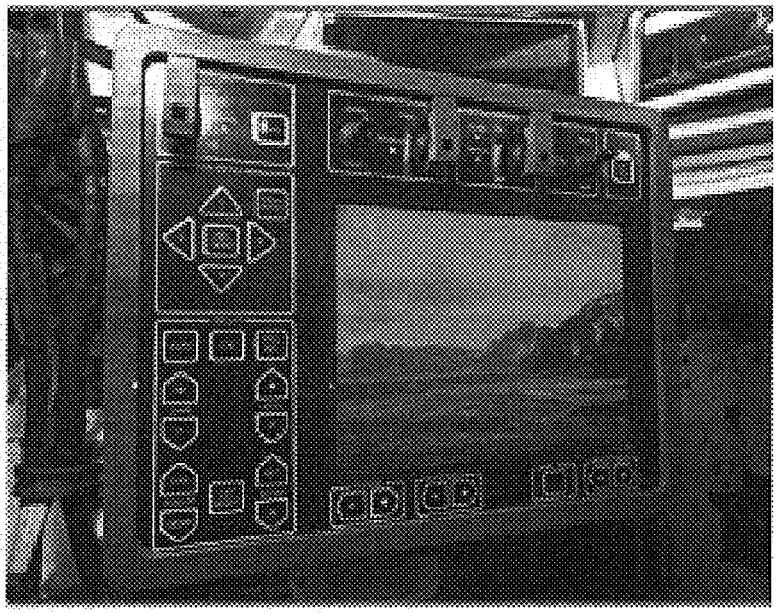
FIG. 26 illustrates an exemplary thermal site for use in an Abrams tank.
Figure 27:
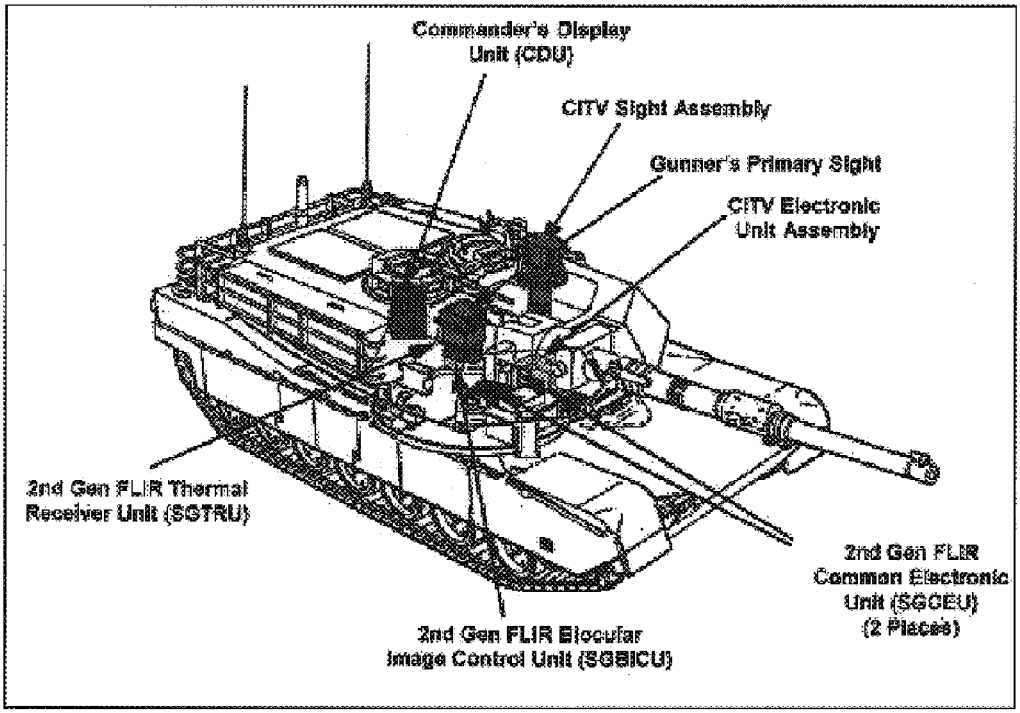
FIG. 27 illustrates an exemplary layout of electronics in an Abrams tank.

The low profile Ku and/or Ka band two-way antennas described herein may be utilized in any number of applications. For example, low profile Ku and/or Ka band satellite antenna may be utilized in military vehicles. In one application, communications "Comm" on the move is implemented allowing a tank or other military vehicle to stay in constant high speed data communication with a command center and other assets under control of a lead vehicle (e.g., other tanks in the same brigade). In Comm on the move applications, the military vehicles receiver may be configured to include a low profile Ku and/or Ka band antenna positioned somewhere on the military vehicles so as to minimize any damage to the antenna. In exemplary embodiments, the low profile antenna may be located on the top of the vehicle, such as shown in FIGS. 23 and 24. The antenna needs to be sufficiently high on the vehicle to avoid water damage when fording lakes or rivers as well as to maintain a clear line of site to the satellite. Additionally, the antenna needs to be mounted such that it can be protected by the armor of the tank from attack. An enemy will normally target the communication and targeting portion of a tank because these portions are most susceptible to attack by small arms fire and shoulder mount projectiles such as RPG rockets.

The low profile for the satellite antenna is of particular importance in military applications. For example, an enemy will often target the communication vehicles and thus, knock out the communication of a column or military unit so that it cannot communicate with Command Center. Thus, satellite antennas (such as current dish or parabolic shaped antennas) are immediately knocked out by enemy positions and anyone having such an antenna is targeted. The low profile antenna allows the antennas to be integrated into every military vehicle and integrated in such a manner that they are not obvious and in fact; do not stick out from the vehicle. The low profile can actually be integrated into the armor in such a manner, as to conceal the communication vehicle's antenna from the enemy. Additionally, the antenna can be protected with a Kevlar or other type of covering, so that the antenna will withstand shrapnel and certain low-impact military projectiles.

A low profile Ku and/or Ka band antenna can be shielded from attach by mounting the antenna on the top of the tank and/or by including armor around the antenna. In addition, the antenna can be covered with a substance such as Kevlar (or other similar substance such as is used in bullet proof vests) that transmits electromagnetic waves while at the same time providing substantial impact resistance to projectiles.

In still further embodiments, the low profile two-way Ku and/or Ka band antenna may be integrated into the hatch or other similar mechanism to provide for minimal cost retrofit applications for existing military vehicles.

The applications for the low profile Ku band antenna on the military vehicles include such applications as logistical information and tactical information. With respect to logistical information, for example, data concerning the status of the vehicle may be communicated back to the command center. Currently, the Abrams tank allows the driver to monitor gas levels, oil pressure levels, temperature readings, and other similar status information. This information could also be sent to the centralized command center so that the center can determine the operational status of each of its assets in the battle field. Such status could not only include the gas level of the vehicle, but also other logistic information such as the number of shells remaining in the vehicle; any repairs that may be desired of the vehicle such as air filters or other routine maintenance items. The status of the vehicle including the type of repairs that are desired can be sent up via the satellite link directly into a logistics center so that logistics and other support vehicles and/or supplies can be dispatched to the military column and/or vehicle to supply the vehicle.

In addition to support items such as logistics, the tank crew could also send and receive E-mails and access various network resources and the internet. In this manner, the tank becomes the mobile home for the tank crew so that even if they are stationed at a remote outpost in the desert, they can have full high speed data communication with their tank command and/or loved ones.

In still further aspects of the invention, the two-way low profile antenna can provide during times behind the lines entertainment data to the troops. For example, in addition to: logistic, tactical, and on-site information; entertainment information such as USO broadcasts or messages from the General or President of the Country may be directed at the troops. Additionally, movies, training films, tactic updates, and/or other announcements from the commander or other information with home such as: e-mail and/or video information allow the troops to stay in touch and keeps moral at a high level.

In addition to logistic information, tactical information can be supplied to and from the vehicle such as, for example: live video feed from the front of the vehicle so that a commander stationed at a central location (e.g., in Florida) can watch in real time the development of the battle from the tank commander's perspective. Further, the complement of the tank crew might even be able to be reduced by having targeting and other operations taken over by remote control. Rather than a four man crew, the tank might be able to operate with a two man crew with the remaining functions being controlled remotely.

The movement of the vehicle, its current position, readings from its thermal imaging cameras and targeting systems and other tactical information could be transmitted from the vehicle to a centralized location. For example, any information that the vehicle may have concerning its current tactical position acquired targets, GPS information from the vehicle, and/or the current targets and hits the vehicle has recorded may be transmitted to a centralized location. The centralized location may have real-time and/or satellite/plane imagery to overlay the tactical information form the field assets (e.g., a tank) to develop a better picture of the battle field. This satellite imagery including the tanks or other vehicles positions (including enemy vehicles position) can then be overlaid on satellite imagery in the tank or at a centralized location. This allows the tank commander and/or any remote command center a complete picture of the battle field. In addition, this tactical information may also provide certain status information of the vehicle (such as whether the vehicle is alive or dead or whether a vehicle has been damaged due to a bomb or other shell or impact). Thus, the tactical commander can have immediate up-to-date information on all of its assets in the field.

Currently, many military and civilian applications include Ku band antennas. However, it is not limited to such. For example, Ka band antennas are fully contemplated by the present application and in fact, use of Ka band will shrink the current dimensions of the present antenna by 80% in every dimension of what it is today. Further, the use of fully electronically tunable antennas which are completely integrated allow for rugged military applications and quick steering over very rough terrain.

In some exemplary embodiments, a mechanical azimuth and elevation adjustments results in approximately a 15 cm height. While this is a low profile Ku and/or Ka band antenna, there are additional optimal designs which may actually improve the height profile of the antenna. In other embodiments, the semi-electronic version having a 5 cm height in which the mechanics are in azimuth but the elevation tracking is done electronically rather than rotating the phase-to-ray panels. By use of electronic tracking rather than manual rotation of the phase-to-ray panels, the only mechanics is the rotation of the platter; thus vastly increasing the reliability of the overall product. Further, still further embodiments of the invention, a fully electronically steerable antenna which has a height of approximately 2.5 cm may be utilized. The fully electronically steerable antenna has substantial advantages over the other designs in that the speed of tracking is virtually unlimited (only limited by the speed of the electronics). Further, the reliability is substantially enhanced such that, it can be used in very difficult and intense environments often encountered by the military. Thus, with the fully electronically steerable module it may be integrated in one or preferably multiple locations on a military vehicle. Where multiple antenna are located on the vehicle, they may be arranged such that they are redundant to increase the difficulty in an enemy knocking out the antenna. Further, a back-up antenna may be located on the underside of a hatch such that the tank can simply open the hatch or slide over an armor cover to reveal a back-up antenna. In this manner, communications may be retained even after an enemy has attempted to target the communications of the vehicle. In addition to the reliability improvements, the weight of the fully electronically steerable module is also substantially reduced allowing the module to be utilized in helicopter, air plane, and fighter jet applications. Additionally, the the profile is shrunk to a level where it is undetectable by enemy troops and placed in a difficult location to target.

In addition to logistic data, communication applications, and tactical data fed back and forth from a central command center, there is also targeted information data sent to a specific vehicle in the battlefield environment. For example, using the low profile Ku band or Ka band antenna, it is possible to provide a tank commander in real-time a satellite overview picture showing the tank commander's tank imposed on a satellite image of the current surrounding of the tank together with information providing overlay on the satellite image of all the other tanks on the battlefield, to which the tank commander is in charge, as well as the enemy tank positions taken via infrared photos. In this manner, a tank commander will know what's over the other hill before he actually commands his tanks and troops to progress over that hill. He can target enemy tanks that cannot even see the tanks of the tank commander. By using the natural trajectory of the tank's shells, the tank commander can use buildings, trees, and other terrain to hid from enemy tanks while at the same time using air plane and satellite imagery (including infared imagery) coupled with GPS correlation to the imagery to target tanks, positions, and other enemy assets that cannot even see the tank. Further, the tank commander as well as all of the other units under the tank commander's command cam know precisely where each other are relative to their own tank so as to prevent friendly fire incidents.

Additionally, the data provided to the tank commander (the targeted information specific data), can be disabled upon any vehicle falling into enemy hands. In this manner, a video inside the tank and/or an explosion indicator will immediately signal the central tank command that a vehicle has been taken over; and that vehicle will be eliminated from any targeted information specific to that vehicle so that it will not be utilized by enemy hands. Additionally, a mechanism such as a key-removal or a clear mechanism will be provided to the troops so that if they are in danger of falling into enemy hands, they can push a button and clear access to targeted specific information.

The on-site networks 201*a* may include a local area network located within a command center, a wireless network between vehicles and/or ground troops located, for example, within 3,000 feet of one another, a Bluetooth network for allowing voice communications from ground troops and/or individuals in the command center, Internet connectivity, connectivity to various military databases, maps, parts, and logistic ordering information. The network 206 may be configured to include any ATM/frame relay, cell relay, sonnet net, Internet, Arpanet, and/or other military and intelligence network. In this manner, on the network side of the communication link, many entities may utilize the same date (e.g., targeting data, video data, logistics data, command and control data) originating from the particular vehicle at the other end of the link simultaneously. Additionally, antennas on the vehicles may collect radio and/or data from enemy transmission for relaying back to a centralized intelligence facility for assessment. Where the transmissions are in a foreign language, they may be forwarded to a centralized translation facility for assessment. In one embodiment, a security agency or other centralized site can use the military vehicles in the field to monitor, decrypt and/or decode enemy transmissions. In still further embodiments, a battlefield commander at a remote location may monitor the view of the commander from each asset (e.g., vehicle) to assess the battle field or disaster area situation for his or herself. This view may be recorded and/or routed simultaneously to a variety of organizations such as the tank commander of the brigade on site, a remote command center monitoring the progress of the battle, an intelligence organization, logistics, artillery, air support, navel vessels, etc., which all may use the same data either at the same time or at a later time to derive intelligence data, ensure that bombs/shells are not being dropped on friendly positions, that the correct assets such as tanks, artillery, bombs, mortars, supplies, ammunition, tanks, and other assets are routed to the positions were they are most needed. The advantage of the network connections 206 is that the battlefield commander decision may be augmented by information obtained and processed from many other assets on the battle field including plane and satellite images (infrared, graphic, etc.), intelligence data, and/or logistic data. Many organizations can have access to huge amounts of data from every military vehicle in the field and make informed decisions about the battlefield management plan.

A centralized command center can be established which may have large LCD/Plasma screens filling the walls. In this command center, a commander can view satellite images/maps of all of his assets. Using a cursor, the commander may zoom in on any one area of the battle field and immediately assess the number of vehicles disabled, the number remaining, the location and type of all of the vehicles, and even zoom to the level of seeing precisely what the commander of the vehicle is seeing out of his window by simply clicking on the vehicle. Still further, by clicking on the command group icon, the commander may see a mosaic of the views from all of the command vehicles on the screen. Any one of these views may be selected and blown up. Cruise Missles, mortors, shells, bombs (including smart bombs), may be targeted in the area where any vehicle and/or command is facing stiff resistance. In addition, the commander may monitor the position, movements, and commands on the ground to ensure that the orders from the centralized command are being carried out correctly.

In still further embodiments of the command display, the commander may view a satellite image of the battle field from above, but may also have a three dimensional view by rotating his angle of view down to the view being seen by each of the assets in the field. Further, software may use the GPS coordinates together with a direction indicator from the vehicle to determine where the camera in the vehicle is pointing. By aggregating the camera images from each vehicle using software, the commander may see a view around the room of the entire battle field from every angle available from any vehicle. These may be concatenated together so that overlaps are eliminated and every angle is covered.

Using the combined GPS, video, and/or targeting data from each of the vehicles (e.g., by marking vehicles that are on the front line and using range finders located within the targeting systems) the command center, command center software, and/or intelligence analysis organization may determine the boundary of the enemy's front lines and troop strength. This information may then be relayed simultaneously to each of the assets in the field such as artillery, navel vessels, helicopters, cruise missile launchers, rocket launchers, planes, and drones to target fire on the enemy positions. An intelligence center or software may determine which assets have the most ammunition and range to reach the desired enemy lines and then direct those assets based on a knowledge base to target the appropriate location. Other assets (e.g., missiles and planes) could target areas that are out of range for other assets.

Additionally, the enemy line finder being handled by the network 206 side of the battlefield management may supply data to close air support such and other air craft. In this manner, an aircraft has position data on all friendly as well as all enemy positions. The close air support can also include the blast radius of the bomb they are planning to drop to ensure the friendly troops are outside the blast radius. The blast radius and therefore the targeting coordinates can be modified depending on type of ordnance being dropped. For example, a 5000 pound bomb will have a different blast radius from an artillery shell. The software can automatically determine the target location for the particular ordinance being utilized taking into account the enemy position, the friendly asset position, as well as the distance and terrain between the two. Thus, if a mountain, hill, or building sits between the friendly asset and the enemy, a closer targeting proximity may be selected. However, if the enemy is too close to the friendly position, a location behind the enemy may be selected so that the deadly range encompasses the enemy, but not the friendly position. Since all of these decisions may be made in real time and communicated to all of the assets in real time, software assist and artificial intelligence routines may be utilized to accomplish this task.

An important aspect of the present invention is that the low-profile Ku and/or Ka band antenna is satellite agnostic. This is particularly advantageous in a military environment such that, wherever a vehicle is deployed in the world, a GPS signal will immediately inform the vehicle where to lock on to certain signals. Additionally, for example, the logistic signals may be provided by a first satellite and the tactical signals may be provided by a second satellite and the on-site information signals may be provided by a third satellite. Thus, a single vehicle is not limited to a particular satellite but in fact, may scan, alter, and change the satellites to which it is connected depending on the current location of the vehicle coupled with the type of information the vehicle which is to receive. This also provides redundancy if one satellite is being jammed or if an enemy has knocked out a satellite.

In addition to being agnostic to various Ku and/or Ka band satellites, the advantage of the present system is that it may use satellites that are in an inclined orbit (in other words, orbiting about the equatorial plane in a figure-eight shape). Because the present antenna is able to track the satellite very inexpensively it is able to track the figure-eight shape of the antenna and therefore, use satellites at the end of their life (for example, a typical satellite may be utilized for a period of approximately 10 years). However, for an additional five years a satellite may be in an inclined orbit and the present invention allows the satellite to be used for an additional five years; thus, increasing the life of the satellite from 10 to 15 years. This has the advantage of: a.) that the satellite segments space is less expensive during the remaining five years or the last five years of the satellite life. Additionally, in military applications it may be advantageous to have a satellite that is not in a stationary orbit but in fact, moves about in position, such that that satellite is more difficult to destroy.

Another application for the low-profile Ku antenna is for emergency communication for first responders in a disaster relief situation. In this environment, a vehicle and/or helicopter and/or mobile communication center transported via helicopter and/or vehicle is equipped with a low-profile Ku and/or Ka band antenna to replace the terrestrial infrastructure which is often not present after a disaster. In this way, the mobile infrastructure and/or vehicle may be connected to, for example: the Red Cross, the military, and other government disaster relief organizations such that appropriate food, shelters, and other materials may be transported to the appropriate locations under command and control from the emergency communication center. Additionally, the government may monitor the movement of food, supplies, and other equipment in and out of the disaster relief as well as review satellite photos of the region which reflect any impacts to the region and locate stranded and/or missing personnel by virtue of the satellite photos. The personnel who are in trouble may be instructed to mark the top of their houses, buildings, or other locations where people are present with a large white 'X' which may be seen from a satellite photo. The satellites may be taken of the disaster area and beamed back to the central emergency communication center for dispatch of personnel to rescue the individuals who are stranded. Upon rescue the white 'X' is therefore, blacked out so that it is not reapproached.

The present application includes any novel feature or combination of features disclosed herein either explicitly or any generalization thereof. While the features have been described with respect to specific examples, those skilled in the art will appreciate that there are numerous variations and permutations of the above described systems and techniques. For example, each of the aspects of the invention in the summary of the invention may be combined with each other and/or with aspects and embodiments of the invention described herein in any combination or subcombination. Thus, the spirit and scope of the application should be construed broadly.

Mobile Medical Services For Disaster Relief and/or Military Field Hospitals

Currently, mobile field hospitals, ambulances, and rescue helicopters use a radio to communicate the patient's condition back to the home base/hospital and then to receive instructions based on the conditions conveyed. Alternatively, the ambulance/medic uses a check list to render services. Even where a doctor is on the other end of the line, the doctor has no way to observe the patient or the situation from a remote location. Thus, his examination is delayed until the patient arrives. Thus, tests and other procedures are also delayed until after this initial diagnosis. The low profile two-way concept allows the doctor(s) at the hospital the ability to monitor remotely medical conditions and view the patients to help guide critical care situations in the hands of a medic. It is not always possible to have all the doctors you need on-site and a two way high speed connection can allow more highly valued personnel to remain in one location while delivering critical care services through surrogates in many locations. For example, if a field unit has a broken leg or other such injury, the medic using a man-pack two-way apparatus can receive more detailed instructions via a video conference with a doctor back at a field hospital.

An extension of the same concept could be used for field repair of tanks and other equipment. Currently, the military has mobile machine shops that are assigned to logistics units. They have all the parts, electronics, and equipment to fix and maintain portions of the battlefield equipment. However, it is impossible to expect the mechanic assigned to the machine shop to be an expert with respect to all of the equipment. This same concept would allow a group of experts to assist in the repair of very complex systems in which the individual mechanics lack expertises. A helmet mounted camera and an ear piece (on the mechanic or medic) would allow a remote expert to walk the mechanic/medic through the repair. This is the same concept as above except extended to the repair of another type of system (mechanical as opposed to organic).

Additional applications for the two-way low profile mobile satellite antenna include dynamic navigation system where the terrain, enemy position, friendly forces positions, mine fields and other data are continuously updated to the vehicle.

Additionally, video file sending and receiving capability (Include recording) may be implemented. Further, the vehicles may have integration with other terresrerial technologies such Cellular, WiFi and WiMax. Further, the vehicle may broadcast information via re-transmitting or a remote user may send information such as video back to a community of users.

We claim:

1. An apparatus comprising a low profile two-way steerable antenna assembly for use on a moving vehicle, wherein the antenna assembly includes at least one dedicated steerable transmit flat antenna panel, and at least one dedicated steerable receive flat antenna panel, separate from the at least one dedicated steerable transmit flat antenna panel;

and a transceiver configured to use spread spectrum coding and decoding.

2. The apparatus of claim 1, wherein the antenna assembly is configured to autonomously acquire and track a satellite while the vehicle is moving.

3. The apparatus of claim 1, wherein the antenna assembly is configured to change tracked satellites depending on a type of needed information.

4. The apparatus of claim 1, wherein the antenna assembly is further configured to dynamically adjust antenna arrangement polarization angles to track a target.

5. The apparatus of claim 1, wherein the transceiver is configured for Ka or Ku band communication.

6. The apparatus of claim 1, wherein the vehicle is a military vehicle, and further comprising:

a processor configured for automatically collecting status information of the vehicle and transmitting the status information back to a command center using the two-way steerable antenna assembly and for receiving information from the command center.

7. The apparatus of claim 6, wherein the status information identifies fuel status of the vehicle.

8. The apparatus of claim 6, wherein the status information is provided on a first satellite and tactical information is provided on a second satellite.

9. The apparatus of claim 6, wherein the processor is further configured to transmit a live video feed from the vehicle to the command center using the two-way steerable antenna assembly.

10. The apparatus of claim 6, further comprising the command center, wherein the command center has a graphic display of a battlefield including an icon for assets in the battlefield including mobile vehicles, and in response to a selection of an icon representing a mobile vehicle, the graphic display is configured to display real time live video feed from the mobile vehicle represented by the icon.

11. The command center of claim 10, wherein the graphic icon also includes location information and status information of the assets including vehicle damage, ammunition and fuel.

12. The command center of claim 10, further comprising a processor configured to combine the status information with logistic ordering information to direct supplies to battlefield positions where they are most needed.

13. A method, comprising:

receiving spread-spectrum coded Ku or Ka band satellite information from dedicated steerable transmit flat antenna panels of a plurality of low profile military vehicle antennas, the information identifying collected status information for military vehicles corresponding to the antennas; and using the information to display a graphic representation of a battlefield having icons representing the military vehicles; and in response to a user selection of one of the icons, displaying a real time live video feed from the military vehicle represented by the selected icon.

14. The method of claim 13, further comprising displaying a mosaic containing a plurality of real time live video feeds from a plurality of military vehicles on the battlefield.

15. The method of claim 14, further comprising aggregating images from a plurality of the military vehicles from a plurality of angles.

16. The method of claim 13, further comprising displaying a satellite overview view; and displaying a battlefield level view.

17. The method of claim 13, further comprising displaying a blast radius view showing locations where particular munitions on enemy targets may cause friendly fire damage.

* * * * *